US007540100B2

(12) United States Patent
Pawlus et al.

(10) Patent No.: US 7,540,100 B2
(45) Date of Patent: Jun. 2, 2009

(54) FOOTWEAR ARTICLE WITH ADJUSTABLE STIFFNESS

(75) Inventors: Christopher J. Pawlus, Andover, MA (US); Peter Dillon, Topsfield, MA (US); David L. Vattes, Londonderry, NH (US); John Healy, Madbury, NH (US); Christopher Adam, Watertown, MA (US); David E. Miller, Dayton, ME (US)

(73) Assignee: The Timberland Company, Stratham, NH (US)

( * ) Notice: Subject to any disclaimer, the term of this patent is extended or adjusted under 35 U.S.C. 154(b) by 305 days.

(21) Appl. No.: 11/436,920

(22) Filed: May 18, 2006

(65) Prior Publication Data

US 2007/0266598 A1 Nov. 22, 2007

(51) Int. Cl.
*A43B 13/42* (2006.01)
*A43B 23/22* (2006.01)
*A43B 1/10* (2006.01)

(52) U.S. Cl. ..... 36/76 R; 36/102; 36/30 R; 36/25 R

(58) Field of Classification Search ..... 36/76 R, 36/102, 30 R, 25 R
See application file for complete search history.

(56) References Cited

U.S. PATENT DOCUMENTS 1,558,192 A * 10/1925 Lindgren ..... 36/156
2,009,684 A 7/1935 Afronte
3,389,481 A * 6/1968 England ..... 36/97
3,517,928 A 6/1970 Shanahan
3,686,777 A 8/1972 Rosen
3,748,756 A 7/1973 White
3,785,646 A 1/1974 Ruskin
4,026,045 A 5/1977 Druss
4,391,048 A * 7/1983 Lutz ..... 36/28
4,430,810 A 2/1984 Bente
4,624,061 A 11/1986 Wezel et al.
4,858,341 A 8/1989 Rosen
4,936,028 A 6/1990 Posacki
4,967,492 A 11/1990 Rosen
5,212,878 A * 5/1993 Burke et al. ..... 36/27
5,220,735 A 6/1993 Raoul-Duval
5,347,730 A 9/1994 Rodriguez Colon
5,353,523 A 10/1994 Kilgore et al.
5,406,719 A 4/1995 Potter
5,729,912 A 3/1998 Gutkowski et al.
5,806,209 A 9/1998 Crowley et al.

(Continued)

OTHER PUBLICATIONS

Dr. Pochatko, www.sroufe.com/rigiflex_shoe.htm, May 11, 2005.

(Continued)

*Primary Examiner*—Ted Kavanaugh
(74) *Attorney, Agent, or Firm*—Lerner, David, Littenberg, Krumholz & Mentlik, LLP

(57) ABSTRACT

An article of footwear or shoe assembly, which is designed to allow for adjustment of stiffness in its sole unit, is disclosed. The article of footwear is preferably constructed to enhance stability, support and comfort of a wearer on varied terrain. Among other elements, the shoe assembly preferably includes an adjustable shank disposed within the shoe to allow for adjustment in the stiffness of the sole unit. In certain embodiments, the adjustable shank further includes a plurality of segments adapted to be manipulated in order to vary the stiffness.

34 Claims, 21 Drawing Sheets

U.S. PATENT DOCUMENTS 5,813,146 A 9/1998 Gutkowski et al.
6,050,007 A 4/2000 Angelieri et al.
6,092,305 A 7/2000 Troy et al.
6,119,374 A 9/2000 Bollard et al.
6,438,872 B1 * 8/2002 Chil et al. ..... 36/97
6,796,058 B2 9/2004 Pochatko

OTHER PUBLICATIONS

International Search Report, PCT/US07/12201.

* cited by examiner

FOOTWEAR ARTICLE WITH ADJUSTABLE STIFFNESS

BACKGROUND OF THE INVENTION

Contemporary footwear is typically designed for much more specific uses than footwear of the past. This is evidenced by the fact that a person may own numerous articles of footwear, for varying activities and situations. Among other types of footwear, a person may have several pairs of dress shoes, several pairs of sneakers or other athletic footwear for different exercising activities such as cross-training, and footwear adapted for cold or inclement weather wear. In addition to these standard articles of footwear, there exists footwear adapted for very specific activities. For example, hiking or trail running may require different types of boots/sneakers depending upon the type of terrain being traversed.

Despite the sheer amount of differing footwear, situations often arise where footwear adapted for a specific activity is required to be utilized in connection with a different activity. For example, varying terrain encountered during a hike or trail run may require footwear with differing sole stiffness. The level of stiffness/flexibility of the sole necessarily determines the amount of flexibility allowed in the footwear. While a hiker walking on flat ground may desire an article of footwear with a more flexible sole, a stiffer sole may be desirable while hiking rocky or steep terrain. Given the fact that most hiking trails vary from flat to steep and bumpy terrain, a single boot/sneaker may not be capable of providing the most desirable comfort to its wearer. In addition, other such situations exist in which a different sole stiffness may be desired or required. For instance, boots/shoes designed for wear at a construction or other similar jobsite may be manufactured with a stiff sole to be suitable for wearing while working. However, the same boots/shoes may not be properly adapted for driving or walking to the jobsite or non-work related activities.

Heretofore, multiple pairs of footwear have been required for adaptation to particular activities. Depending upon the activity, this may necessarily require a wearer to carry different types of footwear at a given time. For example, as mentioned above, a hiker may ideally wish to carry and change footwear depending upon the terrain encountered, and a worker may ideally wear one article of footwear on his/her commute to work, and another while on the jobsite. Thus, it would be desirable and advantageous to provide a single article of footwear that allows for differing sole stiffness.

Therefore, there exists a need for articles of footwear having adjustable sole stiffness.

SUMMARY OF THE INVENTION

A first aspect of the present invention is an article of footwear. The article of footwear according to this first aspect preferably includes an upper defining a cavity for receiving a foot, a sole unit attached to the upper and an adjustable shank adapted to adjustably vary the stiffness of the sole unit. Preferably, the adjustable shank is contained within the article of footwear. In certain embodiments, the adjustable shank includes a plurality of segments forming a one-piece plate, where the segments are connected to one another through, for example, flex points like living hinges. In one particularly preferred embodiment, the adjustable shank includes four segments and three flex points. In others, the adjustable shank includes a plurality of individual, separate segments capable of cooperating with each other. Such separate segments may cooperate with each other through, for instance, tongue and groove members. The article of footwear may further include means for increasing and/or decreasing the stiffness of the adjustable shank. In certain embodiments, the means may be at least one tensioning member, such as a cable, where application of a positive or negative tensioning force to the tensioning cable increases or decreases the stiffness of the sole unit of the shoe. In other embodiments, the means may be at least one adjustable stiffening member, such as a rod, and an adjustment mechanism for causing the adjustable stiffening rod to engage one or more additional segments.

In certain further embodiments of the first aspect, the article of footwear includes an outsole and a midsole, ad the adjustable shank may be located either within the outsole, between the outsole and the midsole or within the midsole, among other locations. In certain cases, the adjustable shank may be located in a channel formed in a portion of the footwear, such as in the outsole. Further, it is noted that the article of footwear in accordance with the present invention may include an adjustment mechanism for adjusting the adjustable shank, such mechanism being capable of cooperating with various portions of the shoe, such as the sole unit and/or upper. In addition, a tension limiter may be couple to the adjustment mechanism and adjustable shank in order to dictate a maximum and minimum amount of tensioning force that may be applied to the adjustable shank. Still further, the adjustable shank may include support blocks to increase the comfort of a wearer of the footwear.

A second aspect of the present invention is an adjustable shank member for use in an article of footwear. The adjustable shank member preferably includes a plurality of segments and an adjustment assembly for adjusting the cooperation between the plurality of segments. The adjustable shank member is preferably adapted to vary the stiffness of a sole unit of the article of footwear. The adjustment assembly for adjusting the cooperation between the plurality of segment may include at least one tensioning cable, where application of a tensioning force to the at least one tensioning cable increases or decreases the stiffness of the sole unit. The adjustment assembly may also include at least one adjustable stiffening rod, and an adjustment mechanism for causing the adjustable stiffening rod to engage one or more additional segments. Other means are also envisioned, as are similar variations to those described above in relation to the first aspect of the present invention. For example, it is envisioned to provide an adjustable shank member having four segments coupled together by three flex points.

A third aspect of the present invention is a method of adjusting the stiffness of an article of footwear. The method preferably includes the steps of providing an article of footwear having an adjustable shank in cooperation with a sole unit therein, the adjustable shank being contained within the article of footwear, and operating an adjustment mechanism associated with the adjustable shank, the adjustment mechanism being at least partially connected to the article of footwear. Preferably, the operating step manipulates the relationship between segments of the adjustable shank to alter the stiffness. In certain embodiments, the operating step causes movement of the segment of the adjustable shank with respect to one another. In addition, the operating step may include applying tension to a tensioning cable in order to achieve the method in accordance with the third aspect or causing a rod to engage selected segments of the adjustable shank to achieve same. The adjustment mechanism or adjustment interface may be internally or externally coupled to the adjustable shank. By way of example only, a footbed of the article of footwear may be removed, the adjustment mechanism may be coupled to the adjustable shank at a position within the article of footwear, adjustment may be made as needed, the adjustment mechanism may be decoupled and then the footbed may be replaced in the article of footwear.

A fourth aspect of the present invention is an interface such as a handle for use with an article of footwear. The adjustment interface may include a body capable of cooperating with a portion of the article of footwear, where actuation of the handle varies the stiffness of a sole unit of the article of footwear. Such an adjustment interface, according to this fourth aspect, may be utilized in conjunction with the above described three aspects of the present invention. In certain embodiments, the adjustment interface may be attached to a portion of the article foot, such as an upper or sole unit of the shoe.

BRIEF DESCRIPTION OF THE DRAWINGS

A more complete appreciation of the subject matter of the present invention and the various advantages thereof can be realized by reference to the following detailed description in which reference is made to the accompanying drawings in which.

DETAILED DESCRIPTION

In describing the preferred embodiments of the invention illustrated in the appended drawings, specific terminology will be used for the sake of clarity. However, the invention is not intended to be limited to the specific terms used, and it is to be understood that each specific term includes all technical equivalents that operate in a similar manner to accomplish a similar purpose.

Figure 1:
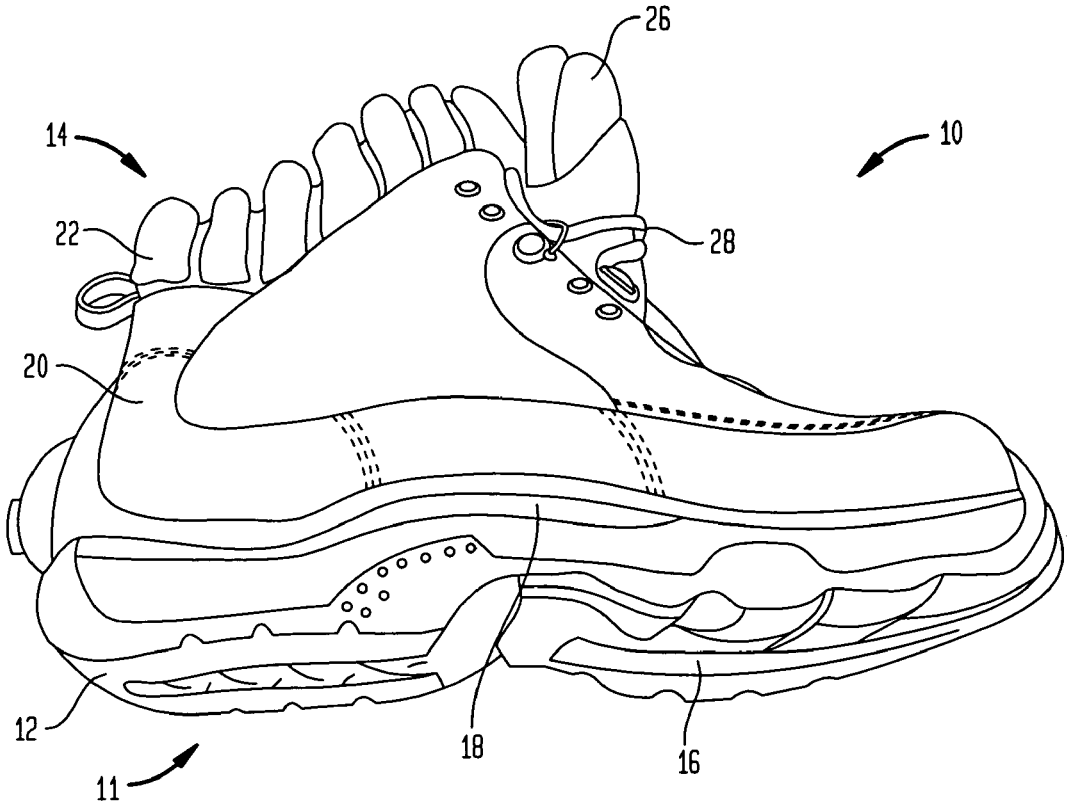
FIG. 1 is a side perspective view of an article of footwear in accordance with the present invention.
Figure 2:
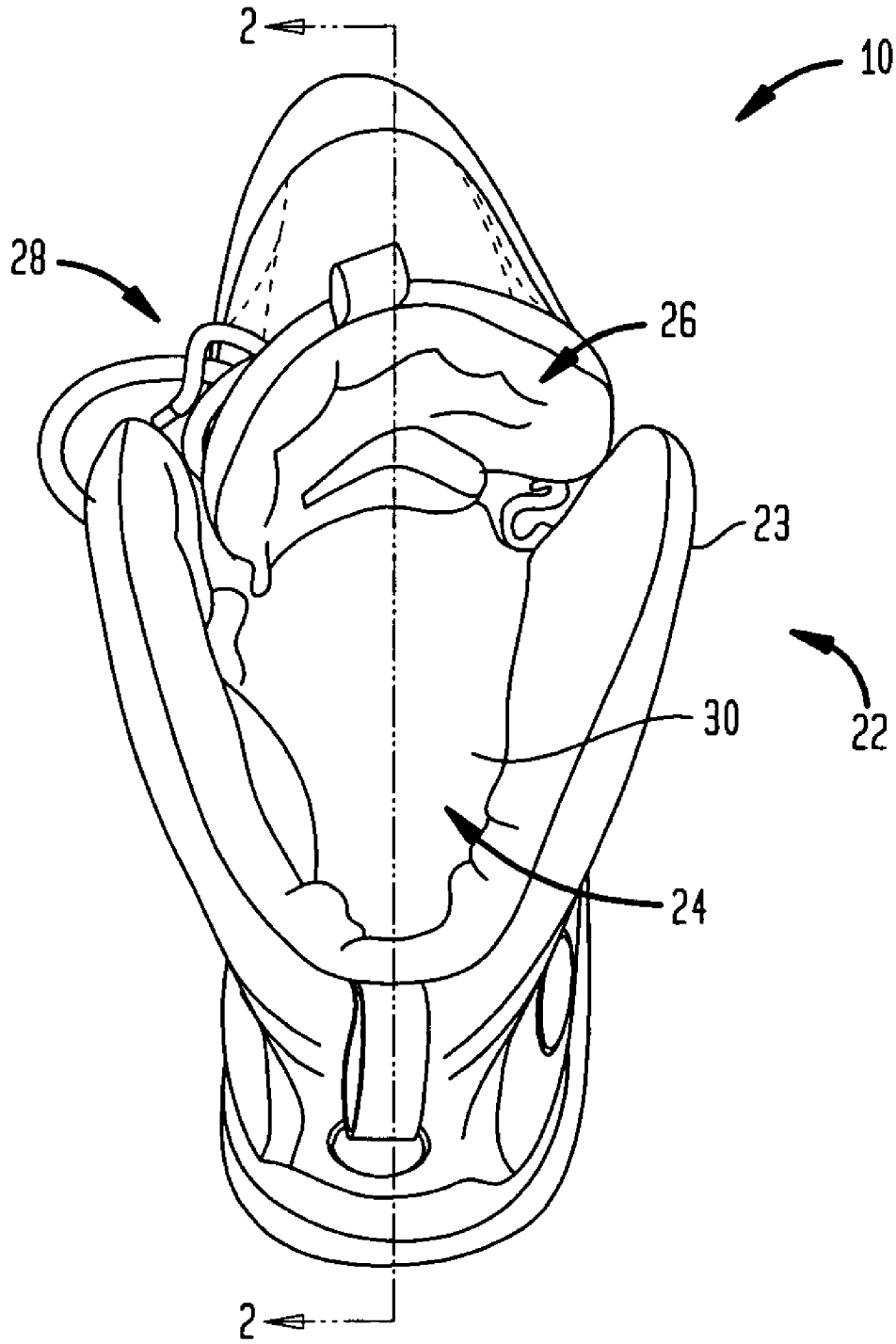
FIG. 2 is a top perspective view of the article of footwear shown in FIG. 1.

Referring to the drawings, wherein like reference numerals refer to like elements, there is shown in FIGS. 1 and 2, in accordance with various embodiments of the present invention, a footwear article or shoe, designated generally by reference numeral 10. As will be discussed further below, shoe 10 is designed to allow for adjustment of the stiffness of its sole unit 11, and thus enhance the stability, support and comfort of a wearer. It is noted that shoe 10 may be any type of conventional footwear type, including, but not limited to dress shoes, loafers, athletic shoes such as sneakers, work boots, hiking boots, sandals, etc. As shown in the preferred embodiment of FIG. 1, shoe 10 includes an outsole 12 and an upper 14. Outsole 12 may include a tread 16 on its bottom, and is preferably connected to upper 14 by a region 18. In certain embodiments, region 18 may be integral with outsole 12, while in other embodiments, it may comprise a separate midsole, a lasting board, etc. In still further embodiments, outsole 12 and upper 14 may be integrally formed as a single piece. Shoe 10 may also include additional features, such as an arch support (not shown), which may be fixed as part of shoe 10 or removable therefrom.

Upper 14 may include a body 20, as well as a collar region 22. Collar region or collar 22 preferably defines an opening that enables a wearer to insert his or her foot into an interior cavity 24 of body 20. Collar 22 may include a top portion 23 of upper 14, as well as certain portions of upper 14 which extend therebelow. Depending upon the height of shoe 10 about a wearer's ankle, collar 22 may extend many inches below top portion 23. In accordance with certain aspects of the present invention, it is preferable for collar 22 to be above the instep of a wearer, in most shoe structures. Preferably, collar 22 has a tongue 26, which the wearer can pull to simplify putting on shoe 10, and body 20 desirably includes laces 28 or other fasteners (such as hook and loop fastening straps, snaps, clips, or the like) useful in securing the wearer's foot in shoe 10.

Shoe 10 also preferably includes a footbed 30 (best shown in FIGS. 2 and 3) which is configured to receive and support a wearer's foot within interior cavity 24. Well known types of footbeds 30 may be utilized in conjunction with the present invention, including custom orthotics, sockliners and the like. Footbed 30 may be formed from resilient materials such as ethyl vinyl acetate ("EVA"), polyurethane ("PU") foams, or other such materials commonly used in shoe midsoles, insoles or sockliners. Footbed 30 may be manufactured using multiple material layers, regions and/or segments, which may each have a different thickness and/or a different rigidity. For example, footbed 30 may comprise multiple layers of different rigidity material. Alternatively, footbed 30 may have different levels of rigidity in the forefoot, instep and heel regions of shoe 10. Finally, footbed 30 may also have a first segment about the first metatarsal of a first rigidity and a second segment about the fifth metatarsal of a second rigidity. It is noted that, in certain embodiments, outsole 12, region 18 and footbed 30 may be collectively referred to as sole unit 11. However, shoes 10, in accordance with the present invention, may employ sole units 11 which include only certain of those individual elements or that utilize additional elements such as an arch support.

Figure 3:
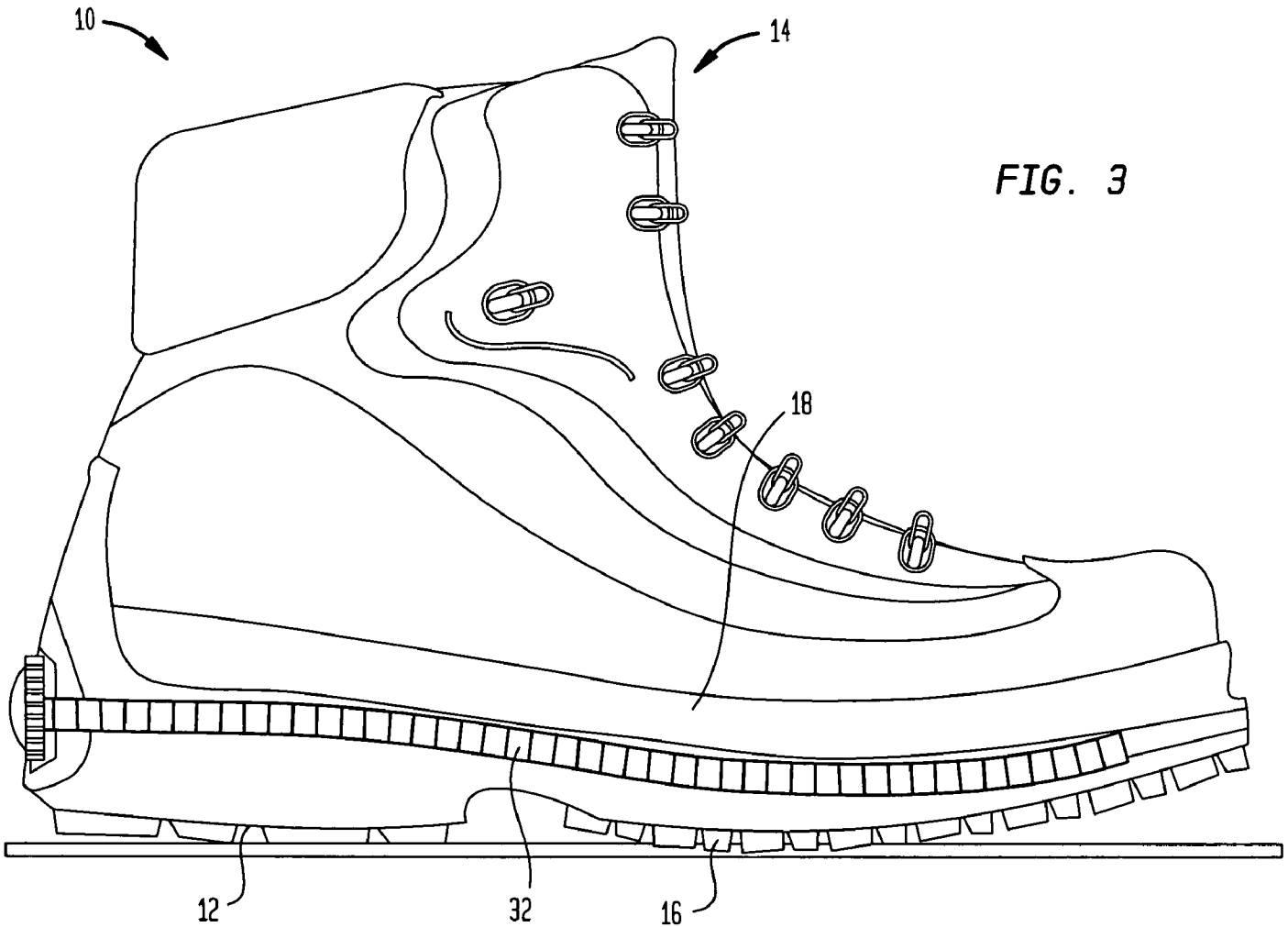
FIG. 3 is a partial side cross sectional view of the article of footwear shown in FIG. 1, depicting the cooperation between the shoe and an adjustable shank.

As best shown in the partial cross sectional view of FIG. 3, shoe 10 also includes a component 32, such as an adjustable shank, which may be a variety of different designs that include different elements. Certain of these designs will be discussed further below, with the general adjustable shank element being consistently referred to throughout with reference numeral 32. The exemplary adjustable shank depicted in FIG. 3 is denoted with general reference numeral 32, and is further discussed below in reference to a seventh embodiment. In accordance with the present invention, adjustable shank 32 is designed so as to vary the stiffness of sole unit 11 of shoe 10. Thus, the above discussed shortcomings of regular shoes, with regard to sole stiffness, may be avoided and the comfort of the wearer improved. In its most general form, shank 32 may include one or more elements or segments which are capable of being manipulated to change a stiffness property of sole unit 11, and thereby the flexibility of footwear upon engagement by a wearer's foot with in shoe 10. The operation of shank 32 may involve moving these elements or segments with respect to one another or with respect to different portions of shoe 10. Preferably, the operation of adjustable shank 32 may be conducted while the foot of a wearer is disposed within body 20 of upper 14.

However, it is clearly envisioned to provide a design which includes an adjustable shank 32 that preferably requires removal of the foot of a wearer and/or is more easily manipulated with the foot removed from shoe 10. For example, designs of shank 32 are envisioned in which it is necessary and/or desirable to first remove a foot from shoe 10 before adjusting the shank. Such a design may allow for a wearer to better visualize the particular position of shank 32 and thereby better determine the stiffness of sole unit 11.

Preferably, shank 32 is capable of being operated by an adjustment mechanism which may be located on any portion of shoe 10. As will be further discussed below, this adjustment mechanism may be many different designs, and, in certain embodiments, may be adapted for use with particular shoe constructions. For example, an adjustment mechanism that is suitable for use in conjunction with a sandal or the like may not be suitable for use with a hiking boot or the like. It is also noted that the particular design of this adjustment mechanism may be such that it provides an aesthetically pleasing addition to shoe 10, which also may vary depending upon the type of shoe 10 being manufactured.

Shank 32 is shown in the preferred embodiment of FIG. 3 as being located between outsole 12 and midsole 18. However, it is to be understood that shank 32 may be placed at any position within or attached to sole unit 11 of shoe 10. For example, in other embodiments, shank 32 may be located entirely in outsole 12, entirely in midsole 18, between midsole 18 and footbed 30, or above footbed 30, among other contemplated locations. Certain limitations with regard to the position of adjustable shank 32 may be its ability to vary the stiffness of sole unit 11 and thus the comfort of the wearer of shoe 10. Further, the position of shank 32 may also be dictated by the particular shoe type and the adjustment mechanism utilized in conjunction therewith. Still further, it is noted that the position of shank 32 should be such that it does not interfere with the overall comfort of shoe 10 for a wearer, and, in certain embodiments, the operation of the shank with the foot of the wearer disposed within body 20 of upper 14.

In accordance with certain preferred embodiments, adjustable shank 32 is preferably situated and integrated into shoe 10 as provided below. For example, adjustable shank 32 can be a layer on or between other common footwear components such as outsole 12, midsole 18, lasting board (not shown), and footbed 30. Most preferably adjustable shank 32 is joined to either the top or bottom of midsole 18. This may enable midsole 18 to accommodate any irregular, non-flat shapes or projections coming from component 32. For instance, adjustable shank 32 may be situated between midsole 18 and outsole 12. In such a construction, a flat side of adjustable shank 32 would preferably be next to outsole 12 with a non-flat side preferably being adjacent to midsole 18. Because midsole 18 is preferably made from compliant foam materials, such as Polyurethane (PU), Ethylvinylacetate (EVA), Latex, or Polyvinylchloride (PVC) foam using either injection molding or compression molding techniques, it can easily be matched to a contour of adjustable shank 32. In addition, midsole 18 can be injected or compressed directly to adjustable shank 32. In certain embodiments, cements may be used to join outsole 12 to adjustable shank 32, and the adjustable shank 32 to midsole 18. Of course, in other embodiments, the same adjustable shank 32 may be placed on top of midsole 18 with the non-flat surface of adjustable shank 32 facing the midsole (flipped over as compared to when adjustable shank 32 is on top of the outsole), in order to provide the same functionality.

Thus, the exact placement of adjustable shank 32 can vary depending on the shoe type and desired outcome. For example, as set forth above, adjustable shank 32 may be glued or cemented (in a manner where the shank is adjustably operable) between outsole 12 and midsole 18. In other embodiments, outsole 12 may include a specially adapted channel for housing adjustable shank 32 therein. In arguably its most simplistic positioning and integration, adjustable shank 32 may be attached to midsole 18 by well known methods such as gluing, and footbed 30 may be laid upon it. It is noted that the particular construction of adjustable shank 32 may adapt it to be better situated in certain positions than others. Finally, it is also noted that the particular construction of shoe 10 (e.g.—boot, sandal, etc. . . . ) may lend itself to having adjustable shank 32 disposed in certain better positions.

Figure 4A:
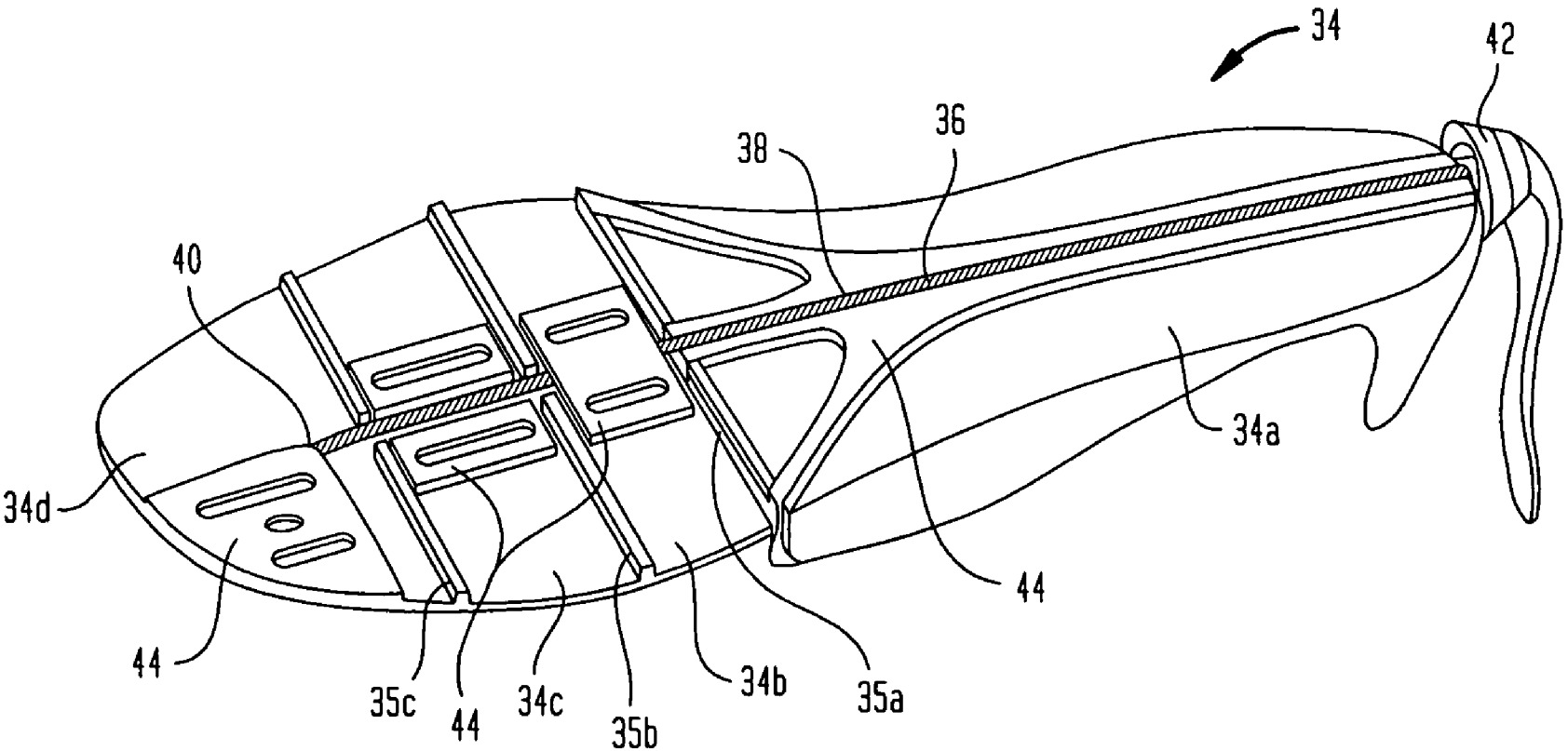
FIG. 4A is a bottom perspective view of a first embodiment of an adjustable shank for use in accordance with the present invention.

Several different embodiments of adjustable shanks 32 will now be discussed. It is noted that while certain of these adjustable shanks 32 are described herein and depicted in the accompanying figures, other embodiments, as well as variances of those shown are contemplated and clearly fall within the scope of the present invention. In a first embodiment, adjustable shank 32 preferably comprises a unitary plate 34 of any number of segments 34*n*, each connected to adjacent segments by respective flex points 35*m*. In a preferred design of this first embodiment, as shown in FIG. 4A, plate 34 includes four segments 34*a*, 34*b*, 34*c* and 34*d*. Each of segments 34*a*, 34*b*, 34*c* and 34*d* are preferably separated from each other by respective flex points 35*a*, 35*b* and 35*c*. It is noted that in this preferred design, segment 34*a* preferably corresponds to the heel section or rearfoot area of a human foot, while segments 34*b*, 34*c* and 34*d* correspond to the front area or forefoot of the foot. Once again, while only four segments 34*a*, 34*b*, 34*c*, and 34*d* are illustrated, it should be understood that any number of segments 34*n* and flex points 35*m* may be employed.

The general construction of plate 34, as well as the other embodiments of adjustable shank 32 discussed herein, should be such that a foot inserted into shoe 10 is capable of flexing in its typical anatomical fashion when positioned in the shoe 10. As the heel section of a human foot is rather inflexible, segment 34*a*, of the preferred embodiment depicted in the figures, is preferably designed so as to be firm and/or stiff. However, the front section or forefoot area of a human foot is generally flexible, and thus, flex points 35*a*, 35*b* and 35*c* provide flexibility to forefoot segments 34*b*, 34*c* and 34*d* (with respect to each other and segment 34*a*), in this same preferred construction. Ideally, in the preferred embodiment depicted in the figures, flex points 35*a*, 35*b* and 35*c* are positioned along plate 34 so as to divide the plate into segments 35*a*, 35*b*, 35*c* and 35*d* which correspond to the rearfoot region, tarsal region, metatarsal region and toe region of a human foot respectively. However, other configurations are also envisioned. In the embodiment shown in FIG. 4A, flex points 35*a*, 35*b* and 35*c* are living hinges. Essentially, these living hinges include an area of thin material between adjacent segments 34*b*, 34*c* and 34*d* of thicker material, and are adapted to allow for the flexing of the adjacent segments 34*b*, 34*c* and 34*d* with respect to one another. In other embodiments, these flex points 35*a*, 35*b* and 35*c* may be sections of differing (e.g., more flexible/inflexible) material, rather than simply more or less material. Preferably, the aforementioned living hinges are designed so as to allow the adjacent segments 34*a-c* to flex in one direction, but not the other, or to minimize flexing in the other direction. This provides for flexibility which more closely mimics that of the flexibility of a normal human foot, while providing for a supportive surface from which to push off from when walking over ground. It is also noted that the various segments 34*n* may be individual segments which are capable of moving with respect to one another.

In accordance with the above, unitary plate 34 may be constructed of any material suitable for providing the necessary flexibility and durability characteristics needed for use in shoe 10. For example, it is possible to construct plate 34 of certain polymer and metallic materials, such as thin stainless steel, thermoplastic urethane (TPU), hytrel, nylon, pebax, and EVA, or combinations thereof. Ultimately, the minimum and maximum stiffness that may be provided to sole unit 11 will be determined by the materials and configuration of both sole unit 11 and plate 34. For example, in hiking boots or the like, where the material utilized in the construction of sole unit 11 is rather durable and strong, relatively stronger materials may be required in the construction of plate 34. Otherwise, manipulation of the plate 34 may be insubstantial in varying the stiffness of sole unit 11. Similarly, in a shoe 10 designed for less rugged use (e.g., a sandal or the like), the design of plate 34 should be such that the plate 34 does not necessarily increase the stiffness to a level which makes the shoe overly stiff or otherwise denigrates the intended function of the shoe. Therefore, it is contemplated to provide different constructions of plates 34 for different model shoes 10 or as removable inserts for the same model. It is also to be understood that relatively less flexible materials may be utilized in the construction of sole unit 11, should shank 32 be of a hardier construction. Clearly a balance is necessary in matching the correct plate 34 to the correct shoe 10 and sole unit 11. This may also vary depending upon the type of footwear for which plate 34 is being utilized in conjunction with. In addition, plate 34 may also be designed so as to include arched or contoured sections which allow for better cooperation with shoe 10. For example, many shoes include an arched section that is designed to support the natural anatomical arch of the human foot. Plate 34 may include curved surfaces that cooperate with such an arch. This may increase the overall comfort for the wearer. However, such cooperative curved surfaces should not interfere with the operation of plate 34.

In this first embodiment, adjustable shank 32 also preferably includes a tension cable 36. As shown in FIG. 4A, tension cable 36 may be situated so as to extend along an approximate midline of plate 34, across or through each segment 34*n*, while at the same time crossing over each flex point 35*m*. However, it is clearly envisioned to situate cable 36 in any other position across any of the provided segments and/or flex points. In a most preferred embodiment shown in the figures, cable 36 is arranged in a channel 38 or the like formed in and across segments 34*a*, 34*b*, 34*c* and 34*d* and flex points 35*a*, 35*b* and 35*c*. However, a channel such as this is not necessary. In a preferred embodiment, cable 36 is constructed of steel braided cable, but may be may other types of material suitable for use with plate 34. For example, cable 36 can be made of any suitable material that is strong enough to provide the necessary resistance in the operation of shank 32. Such suitable materials could include, among other materials, stainless steel braided cables, extruded plastic line and monofilament line, like that commonly used as fishing line. Preferably, it is advantageous to utilize materials which have little to no elongation characteristics when placed in tension. Although not necessary, this may allow for finer control of shank 32, and thus stiffness adjustment of shoe 10, as the user does not have to account for stretch in the line.

A first end of cable 36 is preferably attached to a distal segment, such as segment 34*d* in the preferred embodiment shown, at a first attachment point 40. A second end of cable 36 may be attached to an adjustment mechanism 42, which will be further discussed below. Finally, as FIG. 4A depicts the bottom of shank 32, plate 34 may include several support blocks 44, which are adapted to re-direct the force applied by the foot of a wearer to the various components of shank 32 (e.g.—cable 36 and channel 38). These support blocks 44 are essentially raised areas which absorb the bulk of the force applied by the foot and allow for the components of shank 32 to operate in an ordinary fashion, without the downward weight caused by a wearer's foot adversely impeding operability of shank 32 so as to negate adjustability. Depending upon their positioning, support blocks 44 may provide further comfort to the wearer by better supporting a foot in shoe 10.

The aforementioned adjustment mechanism 42 may be of many different constructions. For example, as shown in FIG. 4A, mechanism 42 is an adjustment interface such as a handle that may be rotated to selectively apply/remove tension from cable 36. In such a construction, as the handle is turned, it preferably operates a screw (not shown) that selectively applies or removes tension from cable 36. Preferably, the handle may be pivoted so that there are two positions: 1)

stored and 2) ready to adjust. In the aforementioned stored position the handle may fit into a recessed area (not shown) of adjustable shank 32 upper 14, midsole 18 or elsewhere, such that it does not protrude from the shoe 10 and create a tripping hazard. On the contrary, when it is time to adjust the tension of cable 36, the handle may be pivoted out of such recessed area, turned to adjust the tension, and then returned to the recessed area. However, it is also contemplated to provide other designs for the adjustment interface, such as a lever, dial, knob or other components like those which that will be discussed further below. Similarly, adjustment mechanism 42 may be located proximate to or adjacent shank 32, or may be located a distance away. For example, it is contemplated to situate shank 32 between outsole 12 and midsole 18 (as shown in FIG. 3) and mechanism 42 adjacent to upper 14. Depending upon the particular construction of mechanism 42 and its cooperation with shank 32, certain situations may be more preferable.

In operation, applying tension to tensioning cable 36 (via mechanism/handle 42), effectively stiffens the joints created between segments 34*n* by flex points 35*m*. Absent a tensioning force being applied to cable 36, flex points 35*m* are generally free to flex under normal conditions, but with such a tensioning force being applied to cable 36, the flex points are essentially forced to act more rigidly or stiffly. This may be due, at least in part, to the particular shape of flex points 35*m*. In a preferred embodiment, these points are configured and shaped so as to allow for their reduction in area upon the application of a tensioning force thereto. This necessarily brings the individual segments 34*n* towards one another and thus limits flexibility of plate 34. As the flex points 35*m* are, for the most part, located in the forefoot area of shoe 10, the flexibility/stiffness of that area is controlled by this operation. Thus, the aforementioned flexible forefoot portion of a wearer's foot may be allowed to retain its normal flexibility or normal flexibility can be reduced if shank 32 is caused to become stiffer through adjustment of tensioning cable 36. As briefly mentioned above, handle 42 may be operated in order to selectively apply/remove tension to cable 36. Preferably, as in the embodiment shown in FIG. 4A, handle 42 is rotated in a first direction (e.g., clockwise) to apply tension and in a second direction (e.g., counterclockwise) to release, minimize or otherwise reduce such tension. However, as mentioned above, other designs are possible.

Figure 4B:
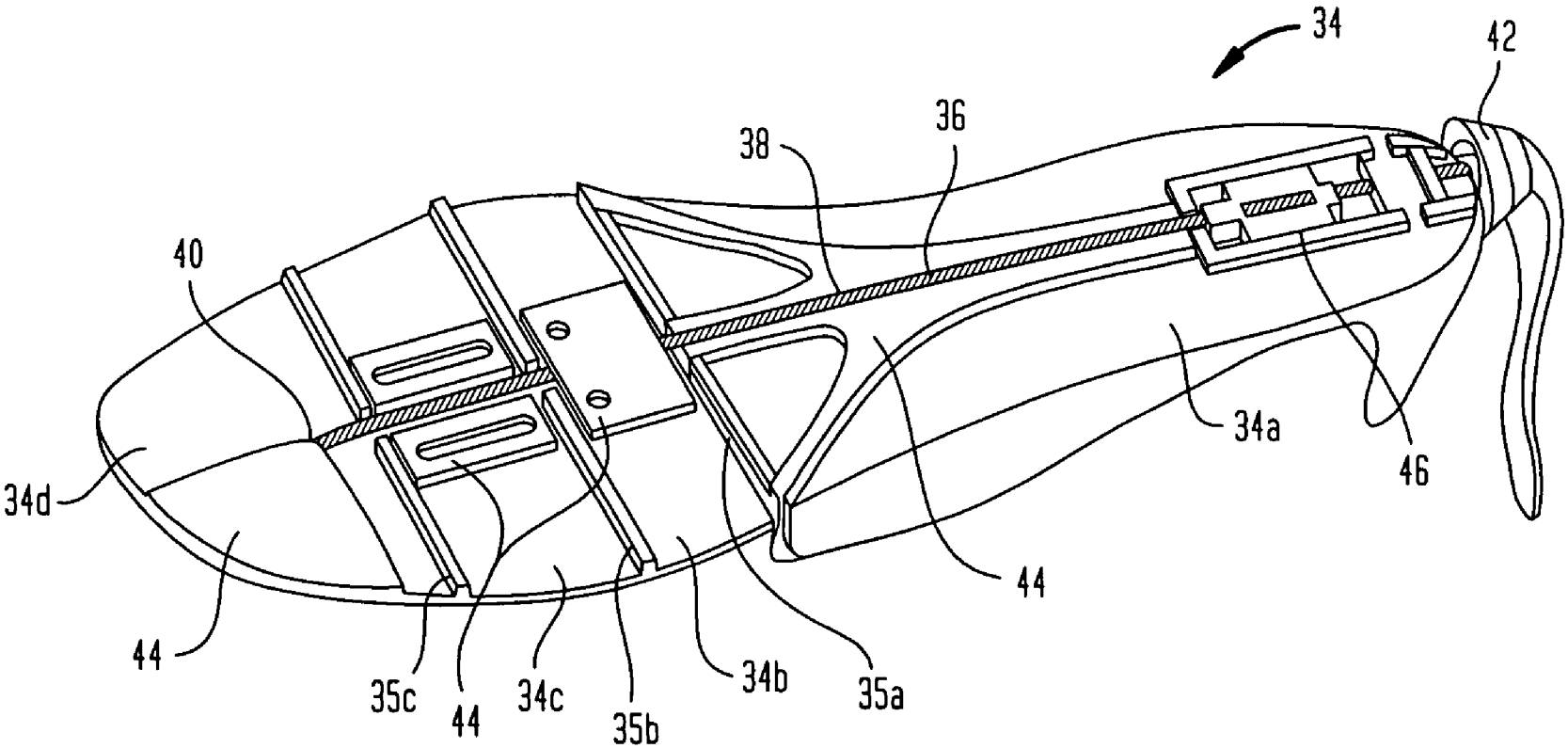
FIG. 4B is a bottom perspective view of the adjustable shank shown in FIG. 4A, employing an adjustment limiter.

In the above discussed first embodiment (shown in FIG. 4A), it is noted that the tension provided to cable 36 may theoretically be infinitely adjustable, with the upper level of tension being determined by the weakest of the mechanical durability of cable 36, mechanism 42, and first attachment point 40. This may clearly affect the upper and lower limits of stiffness/flexibility of plate 34, with the construction of the plate also playing a part. Nevertheless, it may be desirable to control the overall minimum and maximum tension of cable 36. In order to do so, FIG. 4B illustrates a similar design to that shown in FIG. 4A and discussed above. All of the different components of this design are substantially similar, with the addition of a tension limiter 46 to shank 32. However, situated on segment 34*a* in the rearfoot area of shoe 10, limiter 46 is adapted to provide a maximum and minimum stop that correlates to the minimum and maximum tension of cable 36. This, in turn, controls the maximum and minimum stiffness provided by plate 34. In other words, limiter 46 is essentially a mechanical stop and may be placed anywhere within the mechanical chain that creates upper and/or lower bounds for the movement of the tensioning cable. As shown in FIG. 4B, limiter 46 is positioned within the heel region of shank 32. It is noted that the maximum and minimum stiffness allowed by limiter 46 should be such that it correlates with the intention of shoe 10. For example, for a lighter use shoe, such as a sandal, limiter 46 should allow for a low maximum stiffness. Alternatively, for a hiking boot or the like, limiter 46 should allow for a relatively high maximum stiffness. Thus, limiter 46 may itself be adjustable.

Figure 5:
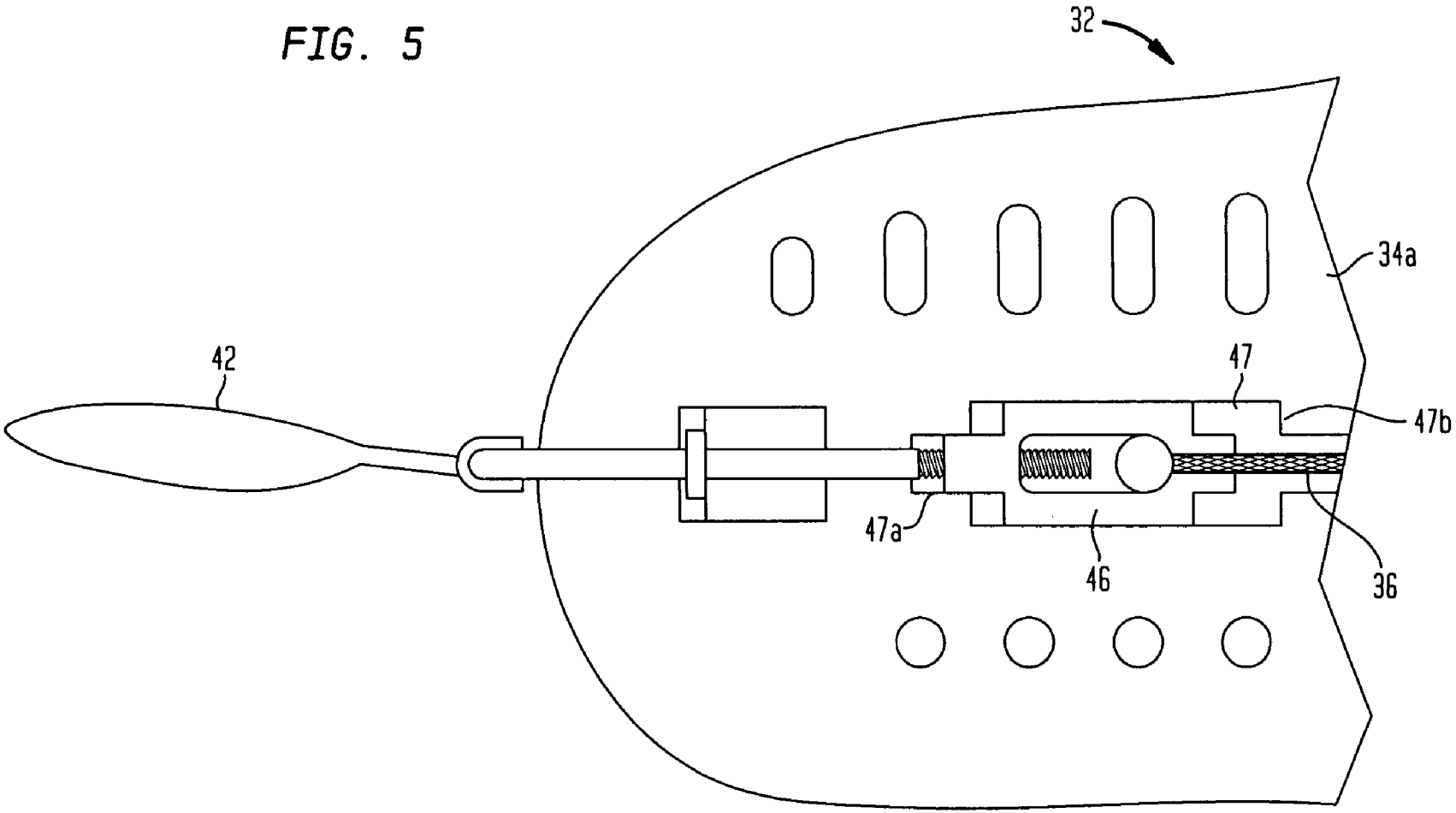
FIG. 5 is a top perspective view of a tension limiter shown in FIG. 4B.

As shown in the more detailed view of limiter 46 in FIG. 5, limiter 46 preferably includes a body (labeled with reference numeral 46) which fits within a similarly shaped and sized channel 47 in adjustable shank 32. Essentially, upon operation of mechanism 42, to either increase or decrease the tension of cable 36, limiter 46 will move within channel 47. When a maximum tension of cable 36 is achieved, limiter 46 will preferably engage a first side 47*a* of channel 47, and prevent any further movement of limiter 46, and thusly additional tension to be applied to cable 36. Likewise, when a minimum amount of tension of cable 36 is achieved, limiter 46 will preferably engage a second side 47*b* of channel 47, thereby preventing further movement of limiter 46, and retaining at least a minimum amount of tension in cable 36. Clearly, the depiction of limiter 46 in FIG. 5 is but one relatively straight forward implementation of the limiter concept. It is envisioned to provide differently shaped and/or sized limiters, as well as those which employ additional components, such as springs or the like.

Figure 6:
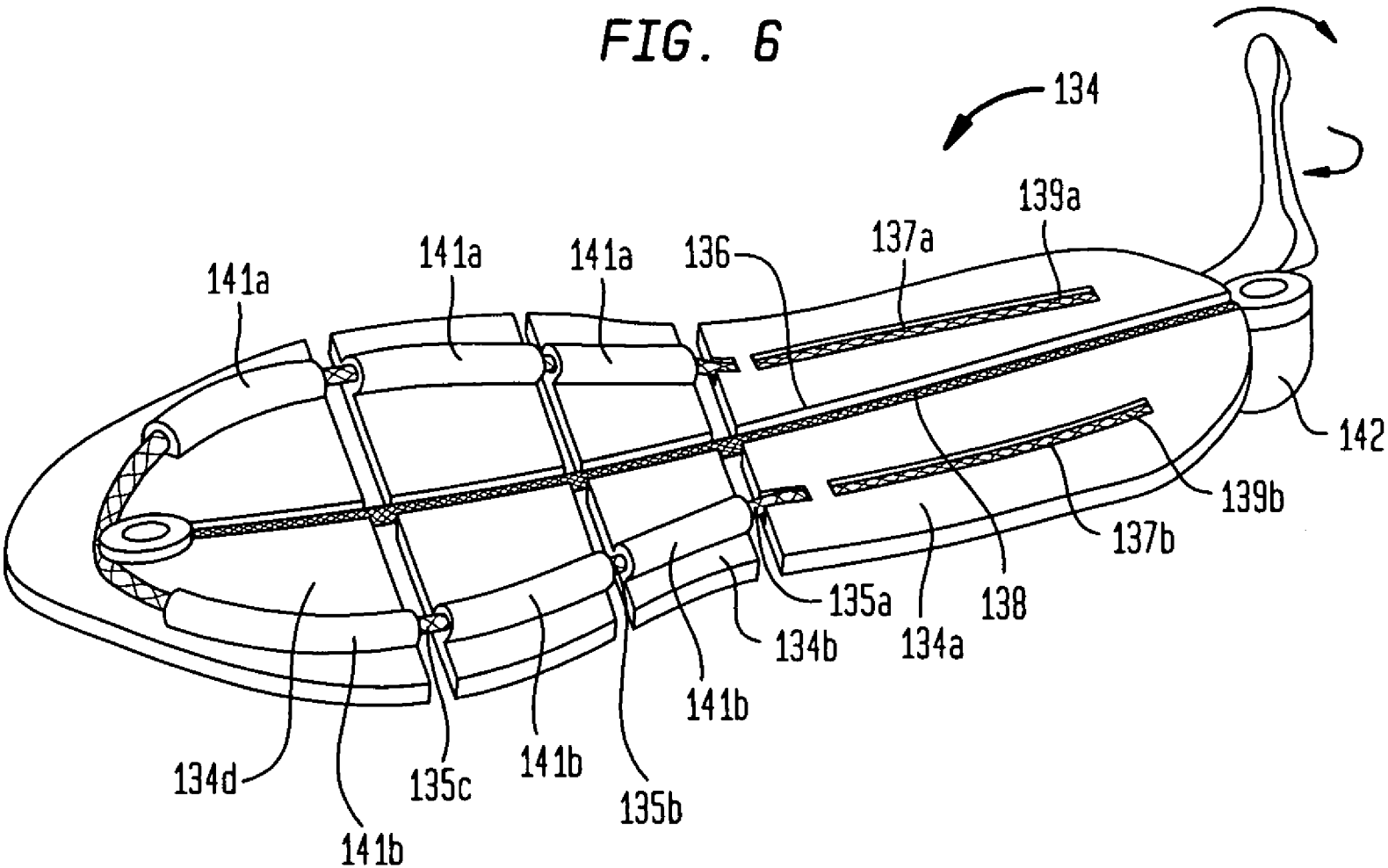
FIG. 6 is a top perspective view of a second embodiment of an adjustable shank for use in accordance with the present invention.

A second embodiment of adjustable shank 32 is depicted in FIG. 6. This second embodiment is similar in design to that of the above discussed first embodiment. For ease of description, like elements to those of the first embodiment will be labeled with similar reference numerals, within the 100-series of numbers. For example, the second embodiment shank 32 comprises unitary plate 134 that preferably includes four segments, 134*a*, 134*b*, 134*c* and 134*d* separated by flex points 135*a*, 135*b* and 135*c*. (As in the above discussion of the first embodiment, plate 134 may have more or less than the 4 segments and 3 flex points depicted in the drawings.) In fact, the only essential difference from the first embodiment, aside from certain insignificant structural differences, is that plate 134 includes, in addition to a similar central tensioning cable 136, two perimeter tensioning cables 137*a* and 137*b*. These two perimeter tensioning cables are both preferably operated, along with cable 136, by a tension adjusting handle 142 (similar to the one employed in the first embodiment). Perimeter cables 137*a* and 137*b* preferably provide for a more uniform or increased application of stiffness to the forefoot segments of 134. As in the design of the first embodiment, the collective tensioning cables of the second embodiment provide for a stiffer plate 134 upon application of a tensioning force to them, and for a more flexible plate 134 upon removal of such a tensioning force. Nevertheless, the addition of two perimeter tensioning cables may increase the uniformity and application of stiffness to plate 134. As is shown in FIG. 6, perimeter cables 137*a* and 137*b* may be partially contained within channels 139*a* and 139*b* (similar to central channel 138), and enclosures or tunnels 141*a* and 141*b*, respectively. However, other configurations are envisioned to guide perimeter cables 137*a* and 137*b*. Further, it is contemplated that the design of the second embodiment may be used in conjunction with a tension limiter, such as limiter 46 of the first embodiment. Operation of the second embodiment is preferably similar to that of the above described first embodiment.

In accordance with this second embodiment, it is envisioned to provide individual separate perimeter cables 137*a* and 137*b*, or to provide one cable that extends around plate 134. In the latter case, the respective ends of the single cable would be connected or otherwise mechanically coupled with and operated by handle 142. In addition, it is noted that handle 142 may be adapted to adjust all of the cables at the same time, or individually. For example, in the case of three separate cables 136, 137*a* and 137*b*, handle 142 may be adapted to provide/release tension with one motion. Alternatively, the handle may include a selector or the like for determining which cable is to be manipulated.

Figure 7:
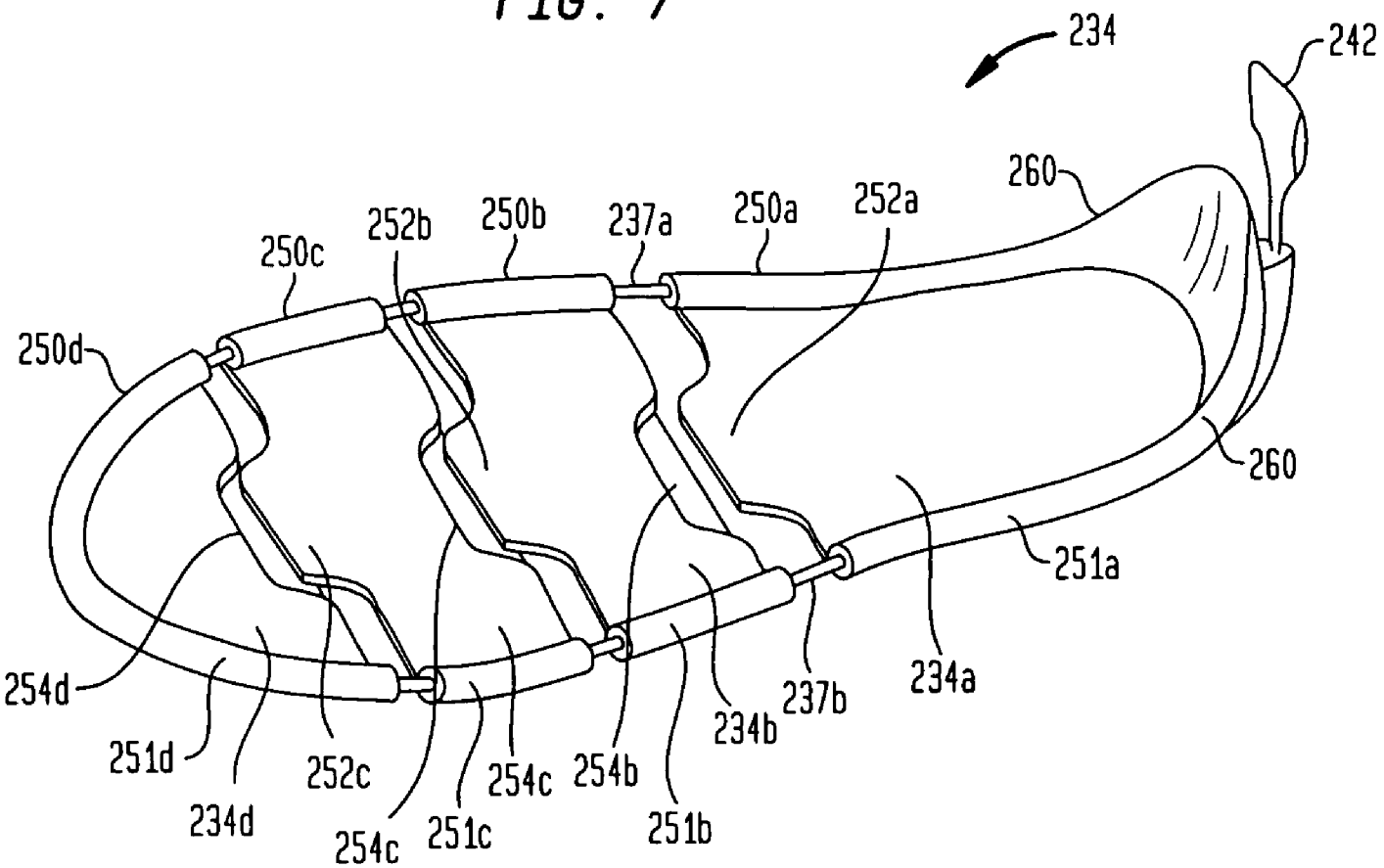
FIG. 7 is a top perspective view of a third embodiment of an adjustable shank for use in accordance with the present invention.

Yet another embodiment of the adjustable shank 32 is depicted in FIG. 7. Once again, like elements to those of the first embodiment will be labeled with similar reference numerals, but within the 200-series of numbers. For example, in this third embodiment, adjustable shank 32 comprises a plate 234 having a plurality of segments such as four separate segments 234*a*, 234*b*, 234*c* and 234*d*. Each of the segments are preferably tethered together by perimeter tension cables 237*a* and 237*b*, which may be shortened/lengthened by operation of a tension adjustment device such as handle 242 in a similar manner as that described in the above embodiments. As shown in FIG. 7, segments 234*a*, 234*b*, 234*c* and 234*d* each preferably include tubular structures on their respective exteriors for receiving cables 237*a* and 237*b*. For example, segment 234*a* includes a tubular structure 250*a* for receiving tension cable 237*a* and a tubular structure 251*a* for receiving tension cable 237*b*. Similar structures, denoted by reference numerals 250 and 251 respectively, are included on each of the other segments, with the letter referring to the particular segment. Segment 234*a* may also include side walls 260 and/or an integral heel cup for receiving and supporting the wearer's heel. Once again, while shown in the drawings to have four segments, plate 234 may include any number of such segments 234*n* in other designs.

Figure 8A:
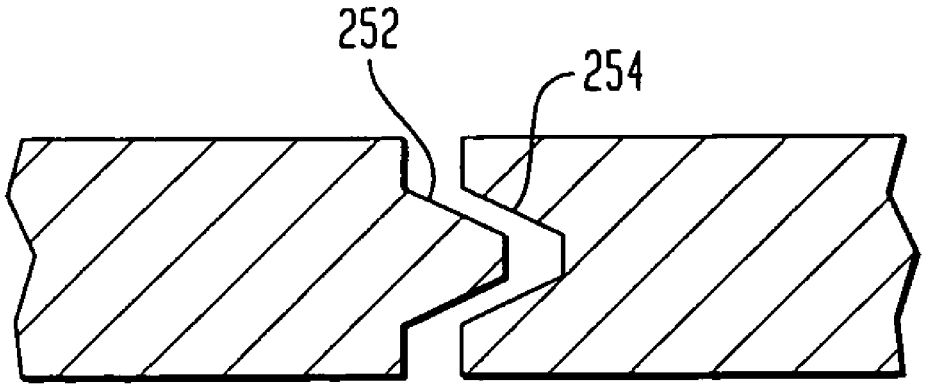
FIG. 8A is an enlarged side view of a tongue and grove joint formed between the segments of the adjustable shank shown in FIG. 7.
Figure 8B:
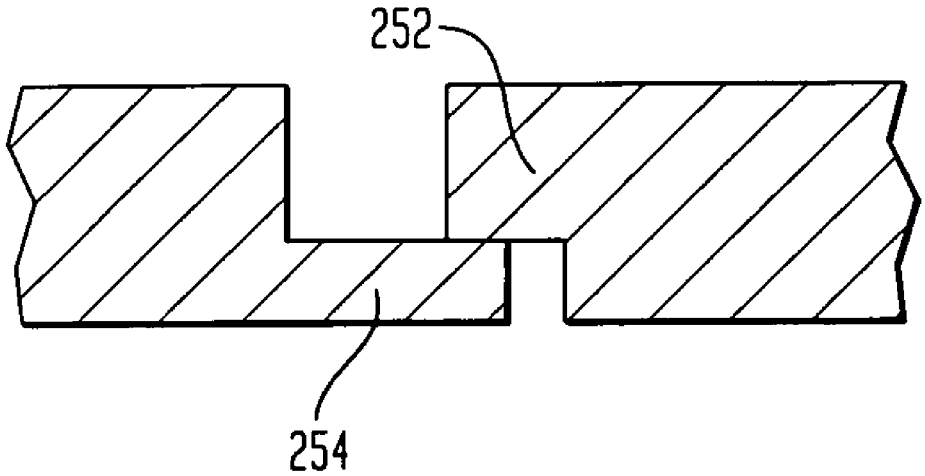
FIG. 8B is an enlarged side view of another tongue and grove joint formed between the segments of the adjustable shank shown in FIG. 7.

In this third embodiment, the different segments are adapted to move independently of each other to thereby vary the stiffness of sole unit 11, without the use of a living hinge or the like. Thus, application of tensioning force to cables 237*a* and 237*b* preferably causes the different segments to move towards one another. Segments 234*a*, 234*b*, 234*c* and 234*d* are further preferably adapted to cooperate or interlock with other adjacent segments upon movement towards one another. As shown in FIG. 7, and the more detailed views of FIGS. 8A and 8B, these segments may include tongue and groove type joints. For example, segment 234*a* may include a tongue 252*a*, and segment 234*b* may include a groove 254*b* (other segments preferably include at least one of tongue 252 or groove 254, with letters referring to the particular segment). FIGS. 8A and 8B depict two different joint configurations. However, other configurations are clearly envisioned. In operation, upon application of a tensioning or shortening force to cables 237*a* and 237*b*, segments 234*a*, 234*b*, 234*c* and 234*d* are at least partly drawn together and thereby at least partly interlock through the cooperation of these tongue 252 and groove 254 joints. Upon the removal of such a tensioning or shortening force, the natural flexing movement of a human foot within shoe 10 preferably causes segments 234*a*, 234*b*, 234*c* and 234*d* to move apart from each other and restore flexibility to sole unit 11.

It is noted that, depending upon the particular design of the tongue 252 and groove 254 joints, it is possible to achieve varying stiffening to sole unit 11. For instance, a mechanism may be adapted to cooperate with cables 237*a* and 237*b* to slowly draw the different segments together. In certain embodiments, the tongue 252 and groove 254 joint may be designed to provide progressive stiffening depending on the level of interlock, so that a joint which is partially interlocked would preferably provide less stiffness to sole unit 11 than a joint which is fully interlocked. It is also noted that the individual nature of the segments of this third embodiment may clearly be applied to any of the embodiments discussed in the present application. One of ordinary skill in the art would understand the modifications necessary in order to construct such a design.

Figure 9:
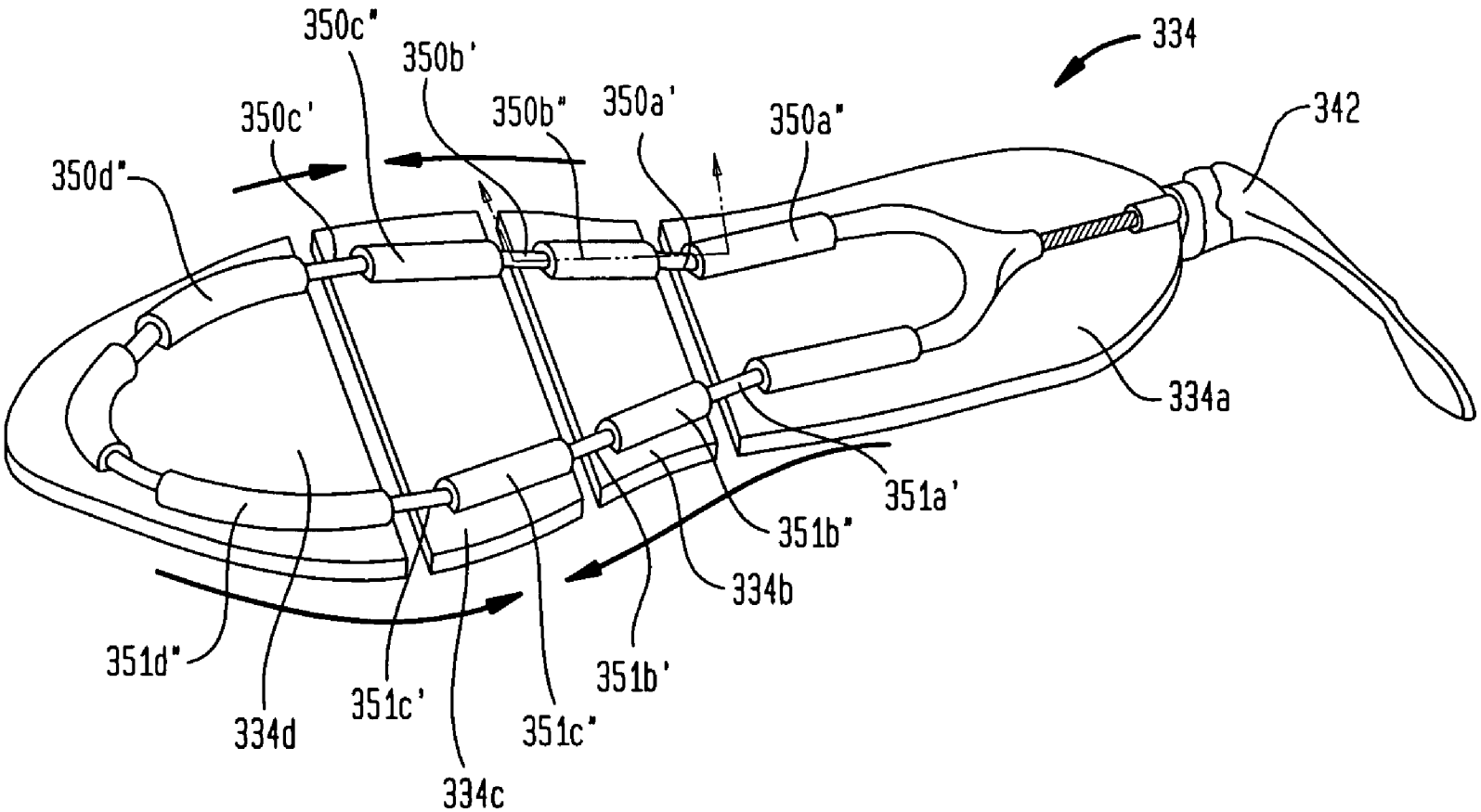
FIG. 9 is a top perspective view of a variation of the adjustable shank shown in FIG. 7.
Figure 10:
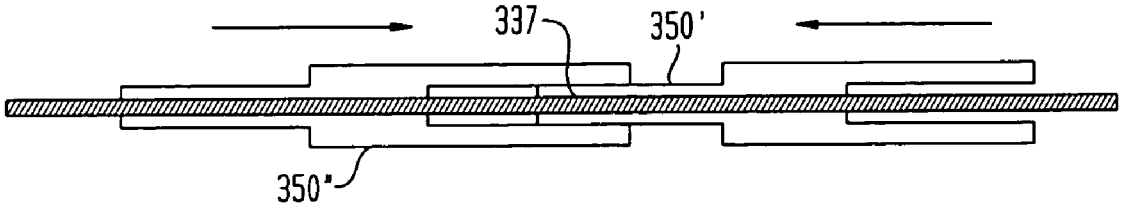
FIG. 10 is a cross sectional side view of the cooperation between the tubular elements of the adjustable shank shown in FIG. 9 taken along line 1-1 of FIG. 9.

FIG. 9 depicts a variation of the above discussed third embodiment. In this variation, shank 32 is a multi-piece plate 334, like plate 234 shown in FIG. 7. Similar reference numerals are once again utilized for like elements. However, rather than perimeter cables 237*a* and 237 and perimeter tubular structures 250 and 251, plate 334 includes more interiorly disposed cables 337*a* and 337*b* (one of which is at least partly shown in FIG. 10) that cooperate with more interiorly disposed tubular structures 350 and 351 (which are denoted for each segment by like reference numerals with a letter designation). Instead of tongue and groove joints, like that of plate 234, tubular structures 350, 351 of plate 334 are designed to cooperate in a telescopic fashion with one another. As shown in the more detailed cutaway view of FIG. 10, the tubular structures preferably include first sections 350' and 351' having smaller exterior diameters for extension into second sections 350", 351" having larger interior diameters, of adjacent tubular structures. Clearly, the diameters of these sections should be dimensioned to allow proper cooperation therein. Essentially, these tubular sections take the place of the tongue and groove joints of the above discussed third embodiment. While shown as being circular, it is contemplated to provide tubular structures 350 and 351 having different shaped configurations. It is noted that aside from these structural differences, operation of plate 334 is substantially the same as operation of plate 234. In certain embodiments, the tubular structures are preferably placed into grooves (not shown) in the midsole.

Figure 11A:
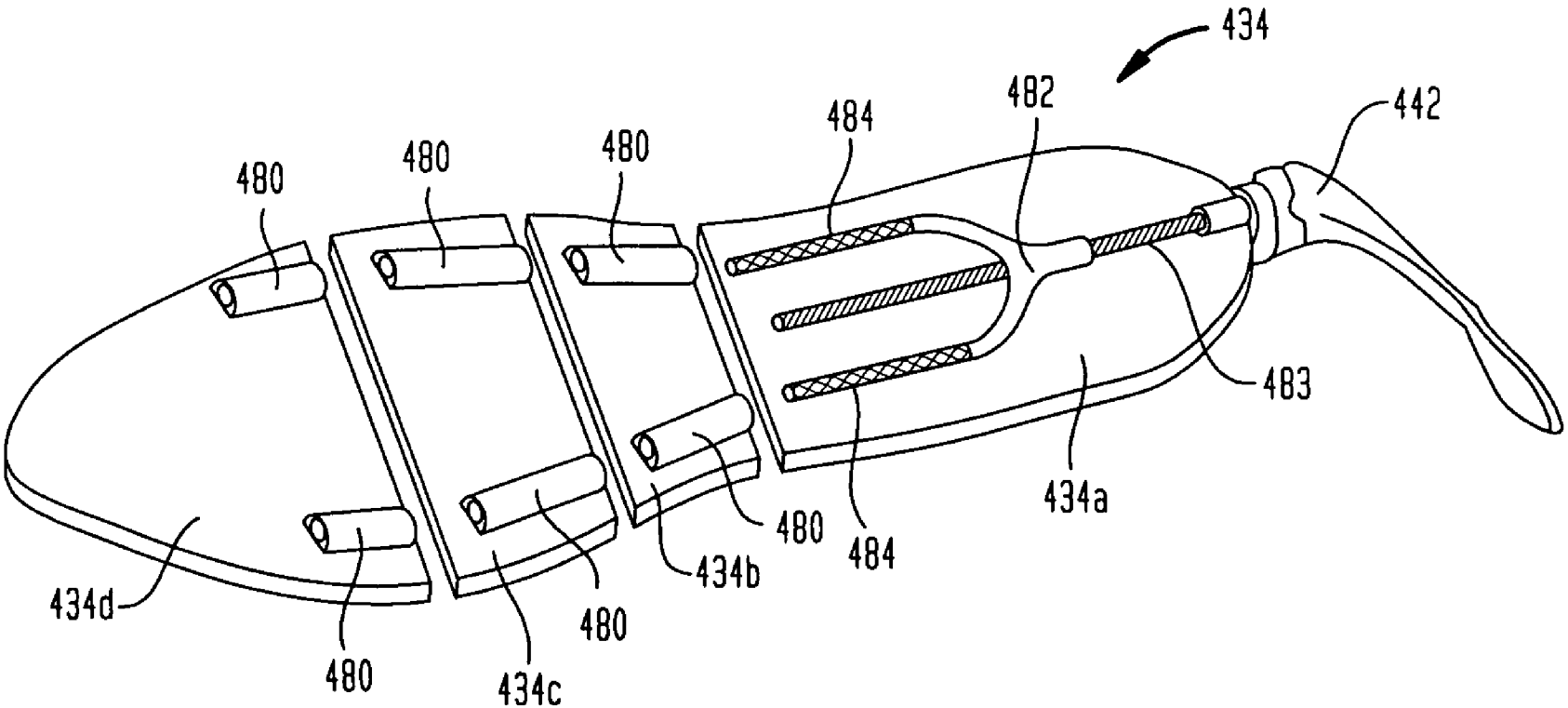
FIG. 11A is a top perspective view of a fourth embodiment of an adjustable shank for use in accordance with the present invention, with the stiffening rods disengaged.
Figure 11B:
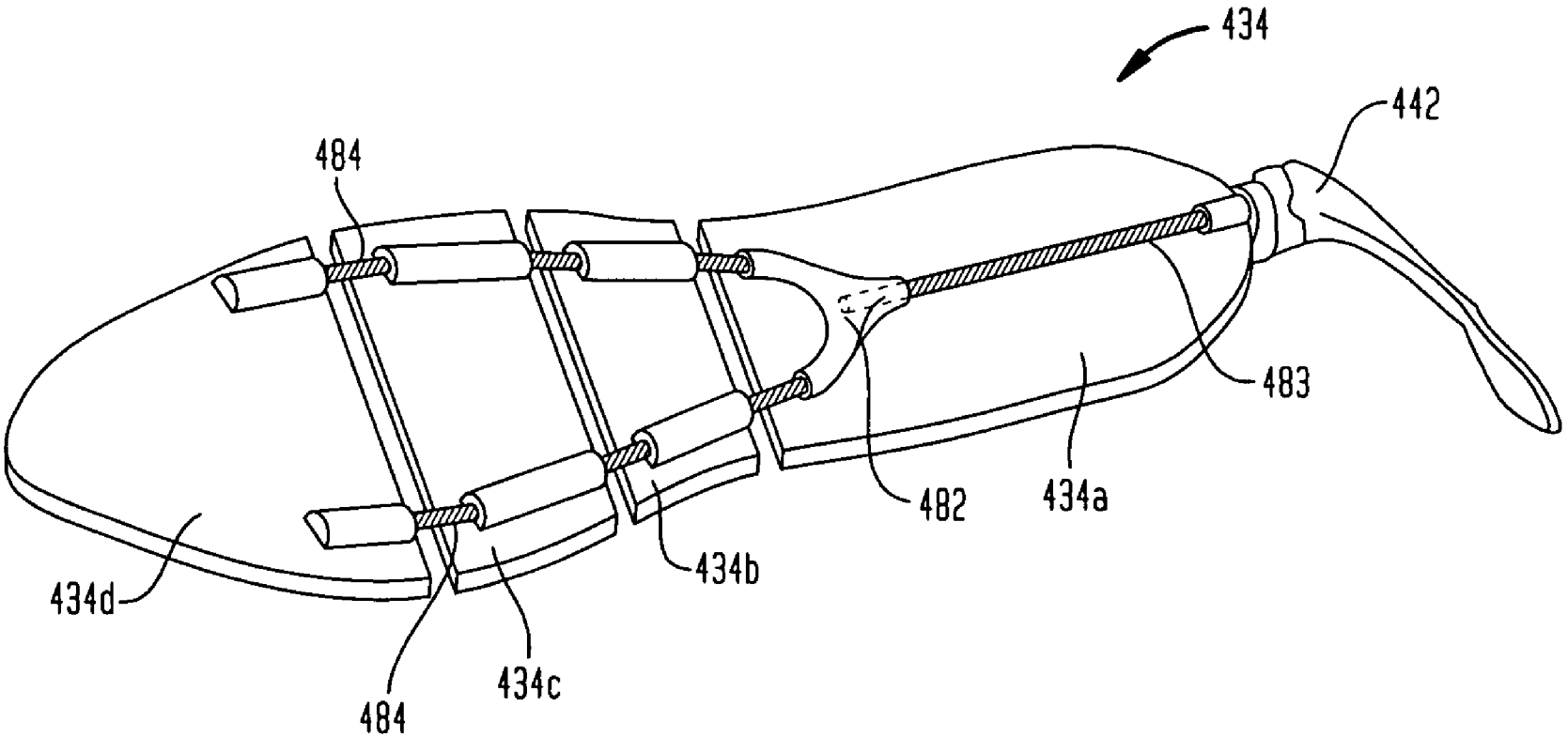
FIG. 11B is a top perspective view of the adjustable shank shown in FIG. 11A, with the stiffening rods engaged.

A fourth embodiment adjustable shank plate 32 is depicted in FIGS. 11A and 11B. This fourth embodiment preferably utilizes plate 434, similar to those described in the above discussed embodiments, which include segments 434*a*, 434*b*, 434*c* and 434*d*. It is noted that the segments of plate 434 may be separated by flex points (like in the first embodiment), or may be individual segments (like in the third embodiment). As shown in FIGS. 11A and 11B, the segments are preferably individual segments as in the third embodiment, although flex points or other linkages may also be used. Essentially, the adjustable shank of the fourth embodiment is adjusted through the cooperation of a plurality of tunnels 480 and a telescopic stiffening element 482, which desirably includes a plurality of stiffening rods 484. It is noted that tunnels 480 are preferably located on each of the segments and are shown in the drawings with letter designations relating to the particular segment. Further, it is noted that the segments may include any number of tunnels 480 (preferably two) for cooperating with a like number of stiffening rods 484 of stiffening element 482. As best shown in FIG. 11A, stiffening members, such as rods 484 may be at least partly disengaged from tunnels 480 when a flexible sole unit 11 is desired, so that they reside along inflexible segment 434*a*. However, as shown in FIG. 11B, stiffening element 482 may be operated so as to "join" the different tunnels 480 together. This clearly, allows for a stiffer sole unit 11 in its forefoot section. Stiffening element is preferably capable of being driven by a handle 442, which upon its rotation, causes a main body of stiffening element 482 to ride along a threaded track 483 or the like. Clearly, the motion of body of element 482 may be in a different direction depending upon the direction of rotation of handle 442. It is noted that stiffening rods 484 may be selectively positioned into tunnels 480, so as to only connect certain of the aforementioned segments. Thus, the wearer can reduce the tension in the front of the shoe, e.g., between segments 434*d* and 434*c*, while maintaining stiffness between the plates 434*c* and

434*b*, and between 434*b* and 434*a*. This allows for the selective adjustment of sole unit 11 to the user's desired stiffness (e.g.,—allowing for selected stiffer sections within different areas of the foot). It is contemplated that a gauge or other system may be employed so as to allow a user to better determine the level of stiffness of sole unit 11 at a given time.

Figure 12:
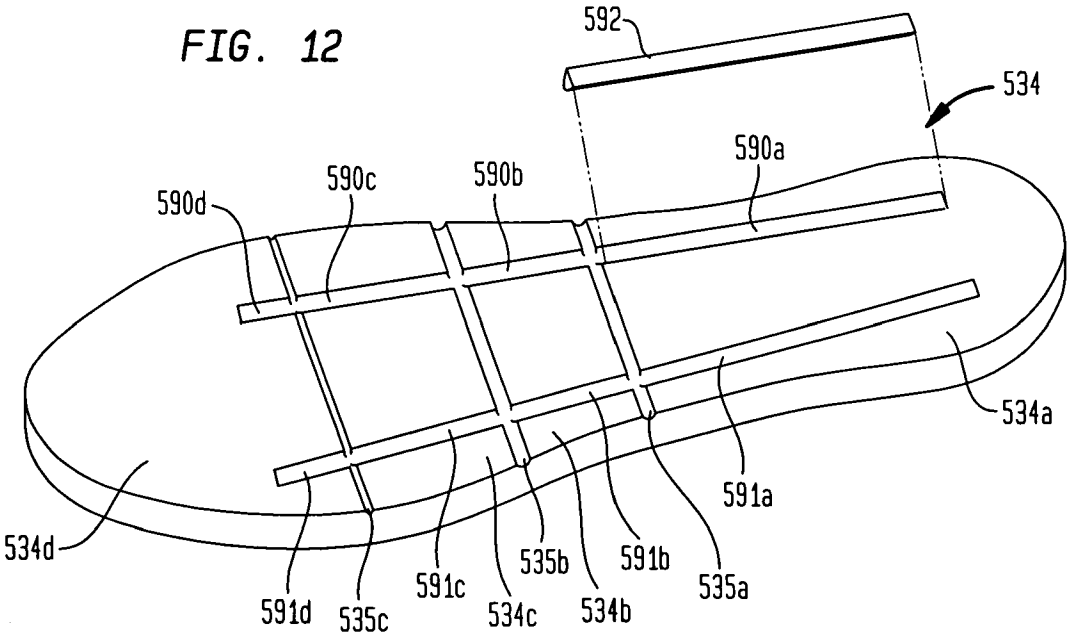
FIG. 12 is a top perspective view of a fifth embodiment of an adjustable shank for use in accordance with the present invention.
Figure 13:
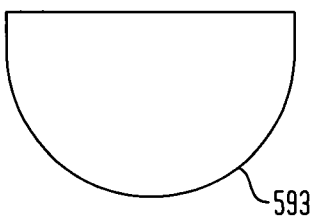
FIG. 13 is a cross sectional view of a stiffening element for use in conjunction with the fifth embodiment depicted in FIG. 12.

Still further, FIG. 12 depicts a fifth embodiment of the present invention. This fifth embodiment is similar in nature and operation to that discussed above in the fourth embodiment. As shown in FIG. 12, the fifth embodiment adjustable shank 32 includes a plate 534 having segments 534*a*, 534*b*, 534*c* and 534*d*. Once again, as in the fourth embodiment, plate 534 may be separated by flex points 535*a*, 535*b* and 535*c* (like in the first embodiment), or may be individual segments (like in the third embodiment). However, rather than employing a stiffening element that is operated through the use of a handle or the like, plate 534 employs a series of channels 590, 591 (with letters designating the particular segment which the channel is located on) and a plurality of manually positionable stiffening elements 592 for insertion into and sliding within channels 590 and 591. In operation, a wearer simply positions any stiffening elements 592 in desired positions within channels 590, 591. As in the above fourth embodiment, stiffening elements 592 may be wholly disposed within segment 534*a*, when a wearer desires the least flexible sole unit 11. However, the elements may be moved further into channels 590, 591 so as to create a stiffer sole unit 11. It is contemplated that stiffening elements 592 may be permanently contained within plate 534 and operated by various procedures conducted by the user, such as removing a midsole 30 and manually moving the elements, or through the use of a magnet which attracts the elements along channels 590, 591. It is noted that the latter means for moving the elements would only work if elements 592 were indeed of a metal construction, and the resistance of movement of such elements is rather small. However, other mechanisms for operation are envisioned. FIG. 13 depicts a cross section of an example stiffening element 592. As shown in that figure, stiffening element 592 preferably includes a beveled and/or rounded edge 593 for allowing for a smoother movement through like shaped channels 590, 591. However, other shapes may be employed, such as wholly circular stiffening elements for placement and positioning in tubes or the like.

Figure 14:
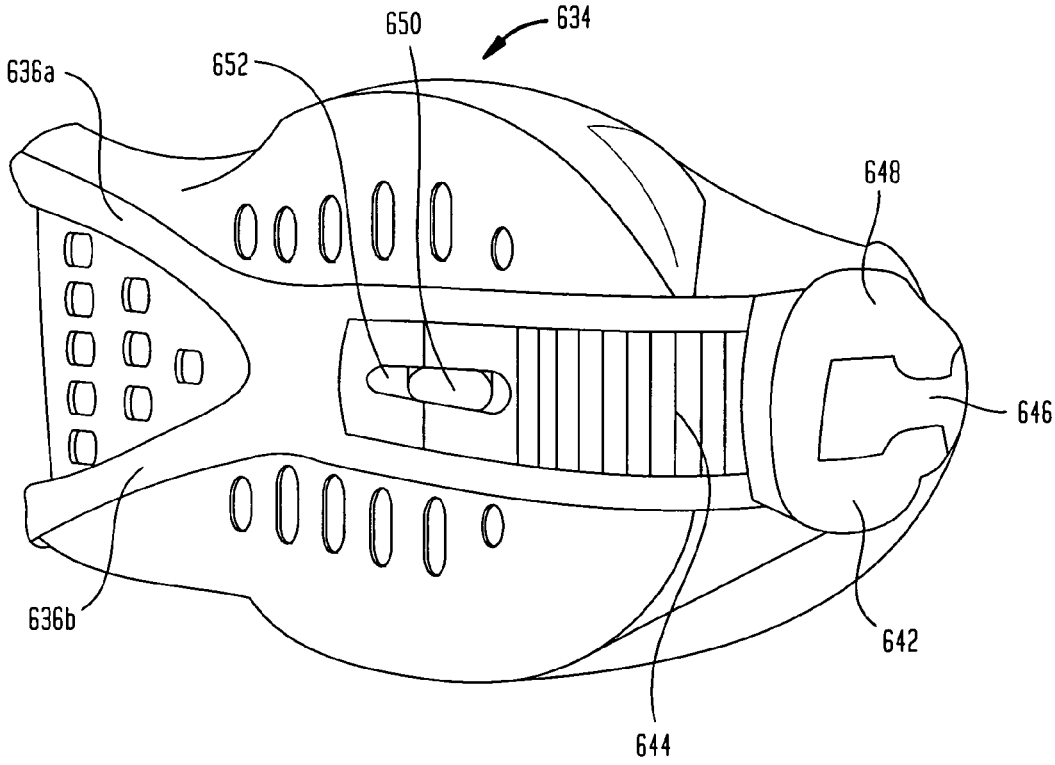
FIG. 14 is a perspective view of a sixth embodiment of an adjustable shank for use in accordance with the present invention.
Figure 15:
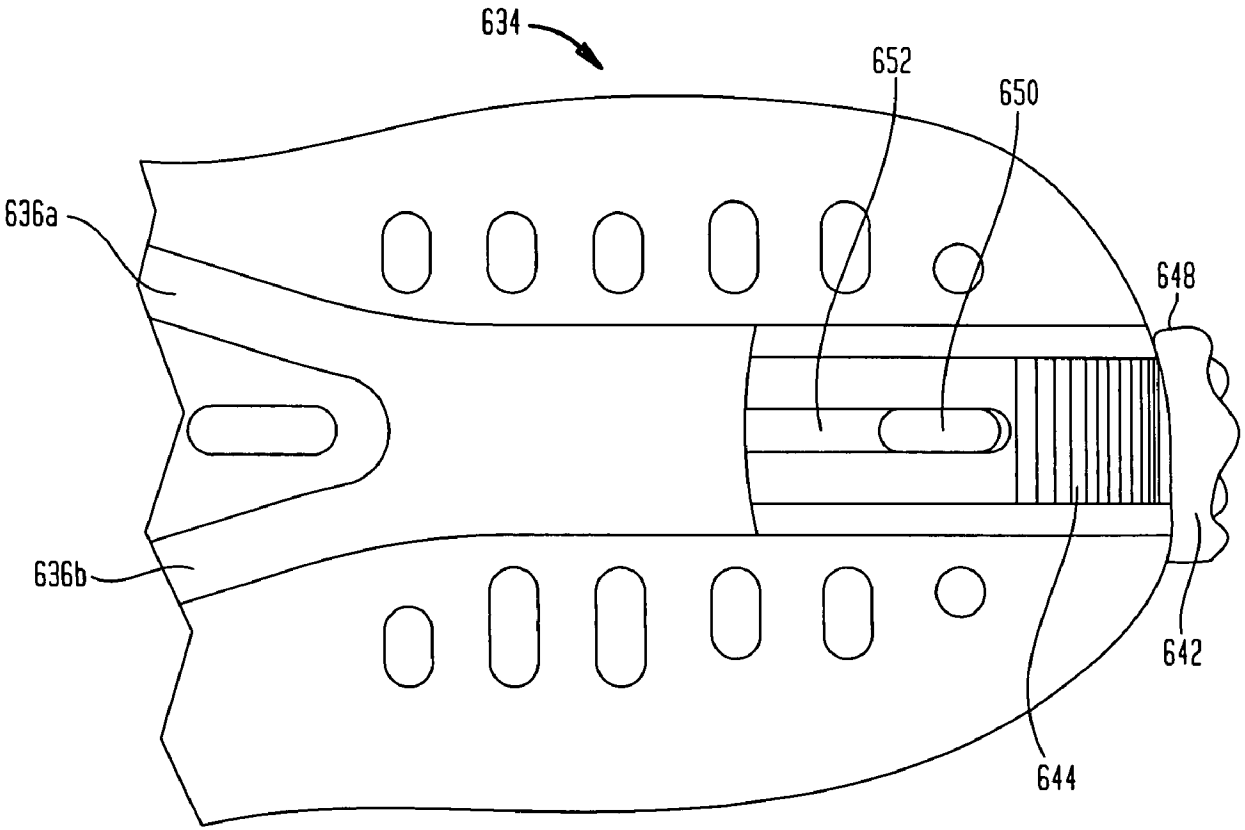
FIG. 15 is a bottom view of the sixth embodiment adjustable shank depicted in FIG. 14.

Yet another embodiment of adjustable shank 32 is depicted in FIGS. 14 and 15. In fact, the adjustable shank depicted in these figures is not only a sixth embodiment shank 32, but also that which is present in the representation of shoe 10 depicted in FIGS. 1-3. It is noted that this sixth embodiment of adjustable shank 32 is similar in construction to that of the first and second embodiments. Namely, the sixth embodiment shank 32 preferably includes a unitary plate 634 employing two cables 636*a* and 636*b* for increasing/decreasing the stiffness of plate 634. In addition, this embodiment includes an adjustment mechanism 642 for adjusting tension of cables 636*a* and 636*b*. As shown in FIGS. 14 and 15, adjustment mechanism 642 is preferably of a ratchet and handle type design. This design preferably produces a straight pull on tension cables 636*a* and 636*b* without wrapping or otherwise using rotary motion to move the cable, like in the first embodiment shank 32 depicted in FIGS. 4*a* and 4*b*.

Figure 16:
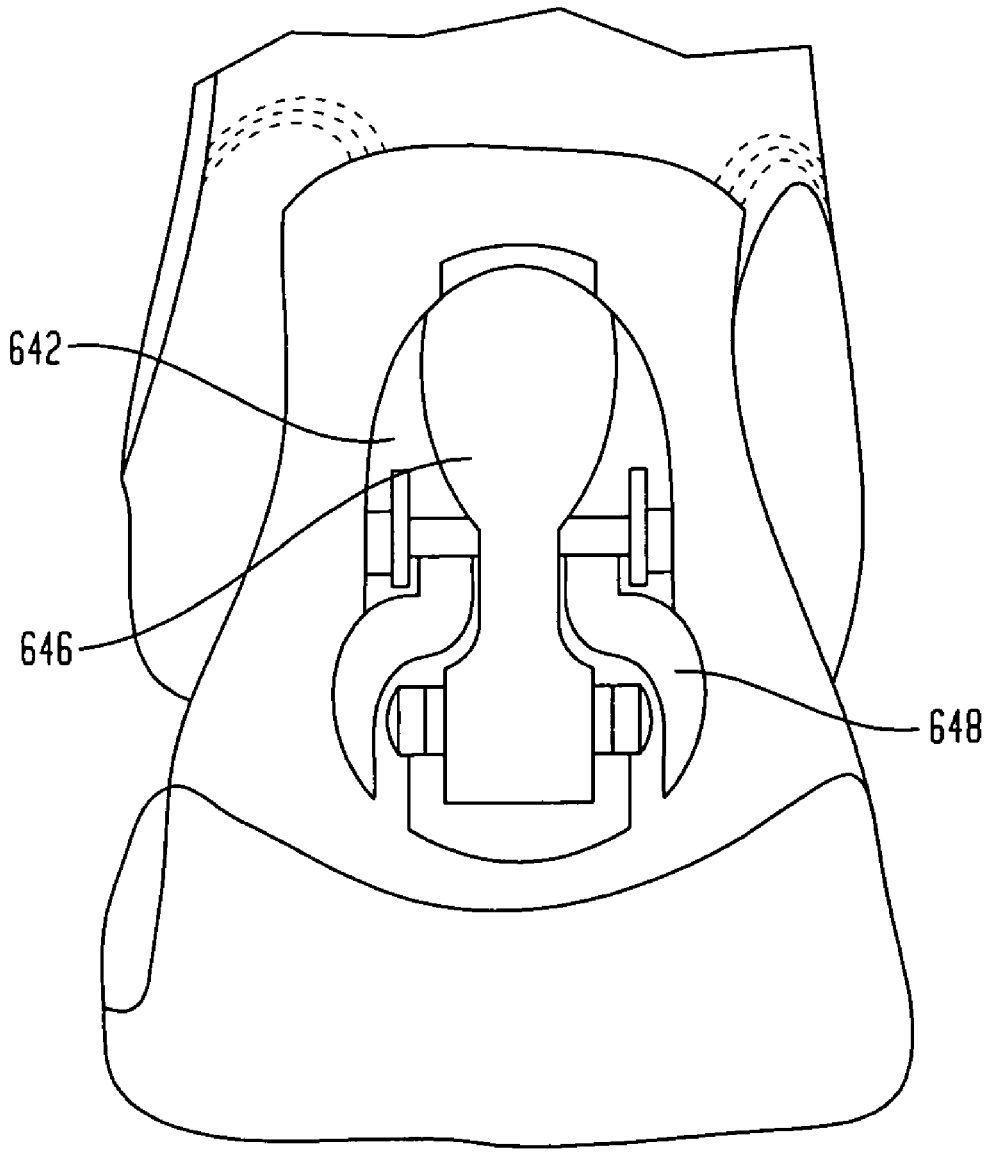
FIG. 16 is a rear view of the article of footwear shown in FIG. 1.
Figure 17:
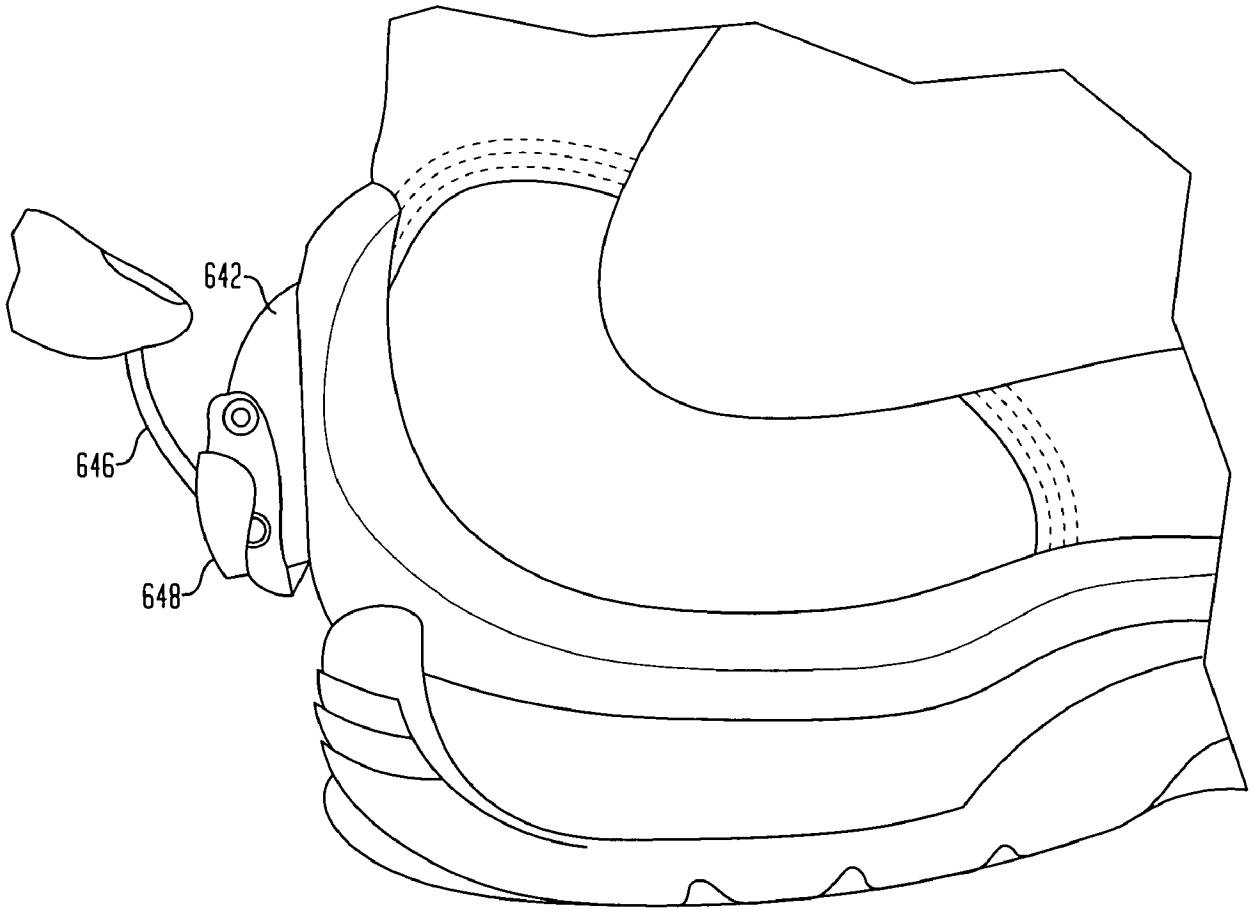
FIG. 17 is a side view of the article of footwear shown in FIG. 1, with a concentration on operation of an adjustment mechanism.

A common ratchet design for use with this sixth embodiment may be similar to that found on cycling shoes, and preferably includes a ratchet 644, ratchet handle 646 and release mechanism 648. This is shown further in FIG. 16. Ratchet handle 646 preferably provides a mechanical advantage in order to move ratchet mechanism 648, thus applying sufficient tension to cables 636*a* and 636*b* when the user desires additional stiffness in the shoe. This operation is best shown in FIG. 17 of the present application. Release mechanism 648 preferably releases a lock from ratchet 644, thereby allowing the tension to be removed from cables 636*a* and 636*b* and flexibility restored to the shoe. It is noted that any well known ratchet design may be employed, as long as there exists a means for quickly and easily applying and releasing tension on cables 636*a* and 636*b*.

Referring to FIGS. 14 and 15, a mechanical stop or other tension limiter 650 may also be included in the apparatus of adjustment mechanism 642. Preferably, such a limiter 650 is placed in serial within ratchet 644. As shown in FIGS. 14 and 15, ratchet 644 preferably has a slot 652 cut into it with limiter 650 protruding into the slot. This provides an upper and lower limit to the tension produced, as the upper and lower end of slot 652 of ratchet 644 will come into contact with limiter 650 upon the application of too much or too little tension. This, in turn, limits the movement of ratchet 644 and, thereby limiting the tension applied to cables 636*a* and 636*b*. Of course, once again, the particular construction of this sixth embodiment may vary depending upon the type and/or size of shoe to employ such a design. In addition, it is noted that adjustment mechanism 642 may vary in its aesthetic appearance depending upon the style of shoe 10 being manufactured.

Figure 18:
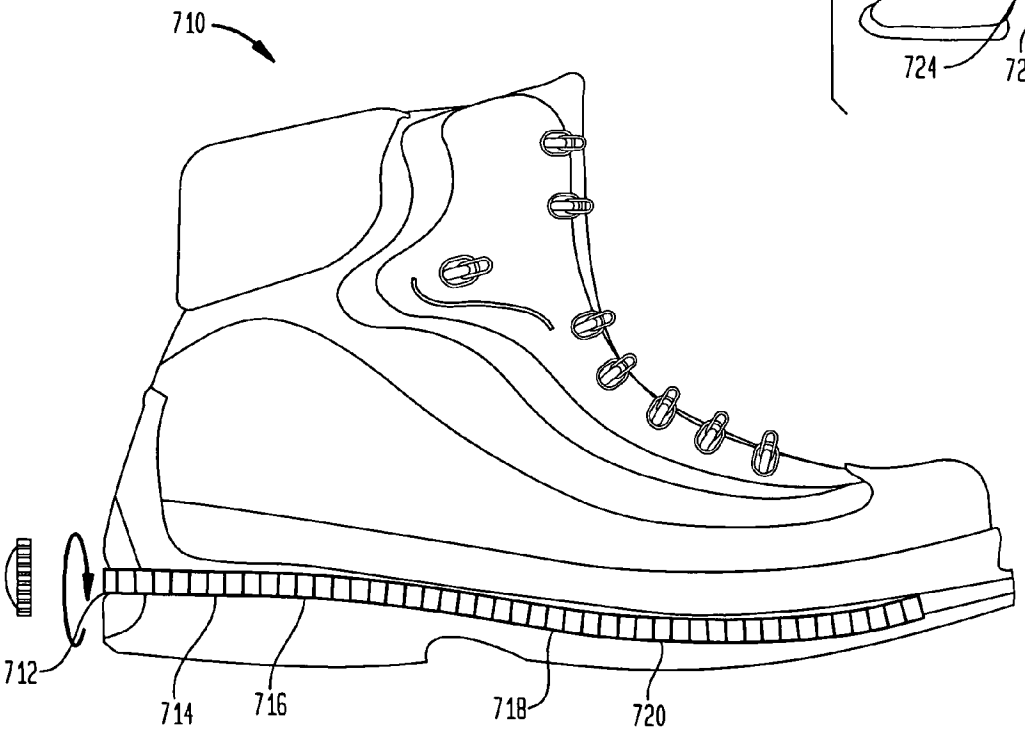
FIG. 18 is a side view of an article of footwear in accordance with a seventh aspect of the present invention.
Figure 21:
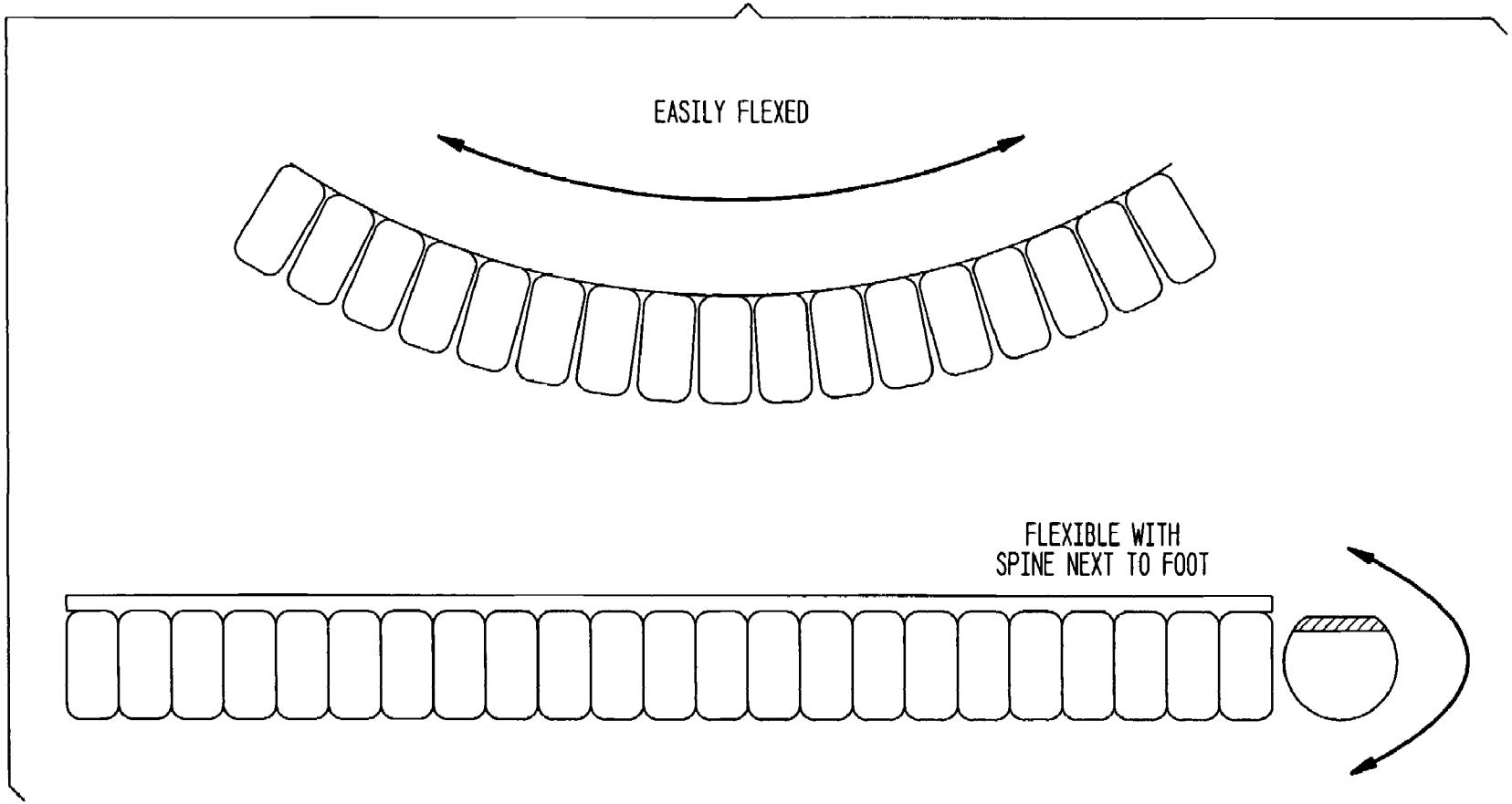
FIG. 21 is an illustration depicting the operation of the adjustable shank depicted in FIG. 20*a*, when in a flexible position.
Figure 22:
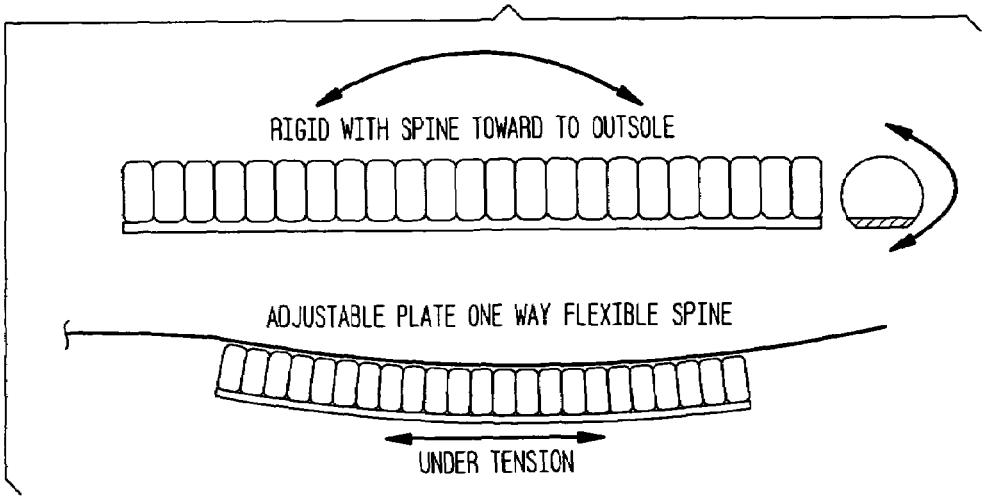
FIG. 22 is an illustration depicting the operation of the adjustable shank depicted in FIG. 20*a*, when in a rigid position.

Finally, FIGS. 18-23 depict a seventh embodiment adjustable shank 32 of the present invention. As shown in FIG. 18, this seventh embodiment shank includes a tube-like structure 714 placed within a channel 712 of a shoe 710. Preferably, channel 712 is formed in a sole unit portion of shoe 710, similar to that discussed above in relation to shoe 10. Likewise, the remaining portions of shoe 710 are similar to that of above-discussed shoe 10, with 710 also being capable of embodying many different variations in design and appearance. Tube structure 714, as shown in the figures, is essentially a solid tube having a plurality of horizontal slits 716 formed therein, so as to create a plurality of connected segments 718. It is noted that slits 716 are preferably formed only partially through tube 714, thereby forming the aforementioned connected segments 718. In addition, it is noted that slits 716 are preferably formed in the same direction, thus, not only creating segments 718, but also resulting in at least one solid side 720.

Preferably, tube 714 is of a circular cross section, and placed within a similar circular channel 712. An adjustment mechanism 722 may also be provided, which, as shown in FIG. 18, may be a dial structure capable of rotating tube 714. In operation, a user would preferably rotate tube 714 depending upon the desired stiffness of shoe 710. With solid side 720 facing or closest to the user's foot, segments 718 are preferably capable of bending with respect to one another during normal foot bending (best shown in FIG. 21). This, in turn, allows for shoe 710 to bend with the user's foot. However, with solid side 720 facing away from or farthest from the user's foot, segments 718 can no longer bend with normal foot bending (best shown in FIG. 22). Rather, segments 718 are forced towards one another, but clearly cannot impede upon each segment's particular space. This, in turn, prevents shoe 710 from significant bending. Finally, situating tube 714 so that solid side 720 is in a position between the two above-noted positions with respect to the user's foot may produce stiffness characteristics therebetween.

Figure 19:
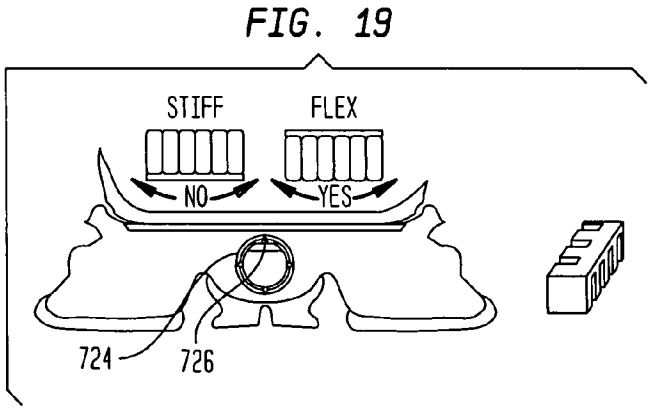
FIG. 19 is a rear view of the article of footwear depicted in FIG. 18.
Figure 20B:
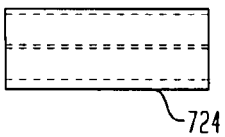
FIG. 20*b* is a side view of the adjustable shank depicted in FIG. 20*a*.
Figure 20A:
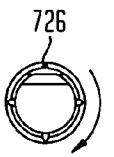
FIG. 20*a* is a longitudinal view of an adjustable shank utilized in the seventh embodiment.
Figure 23:
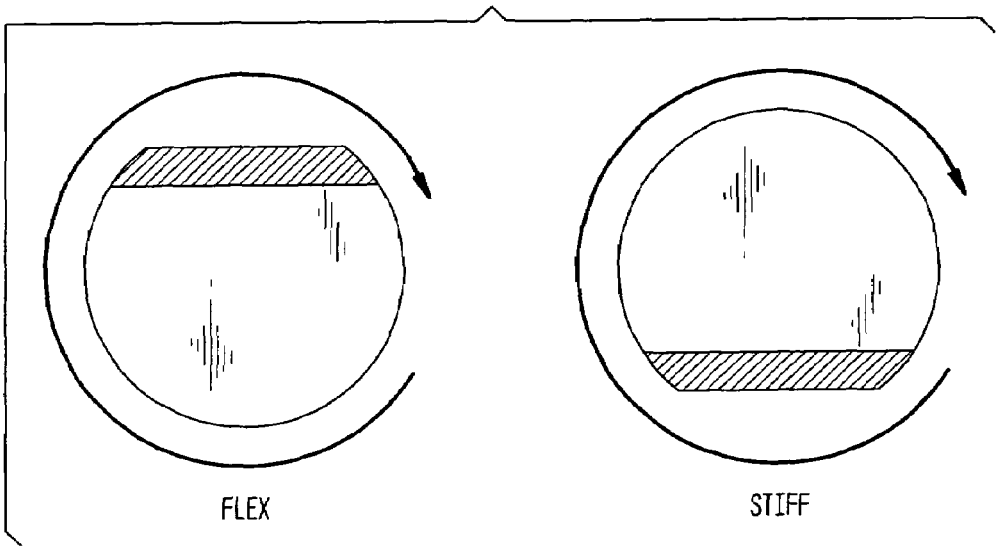
FIG. 23 is an illustration depicting the adjustable shank depicted in FIG. 20*a* in both flexible and rigid positions.

With regard to this seventh embodiment, it is noted that multiple variations are possible. For example, as depicted in FIGS. 19 and 20, tube 714 may include indicators in the form of rib and groove elements, 724 and 726 respectively, which allow a user to more precisely position tube 714. These indicators may also allow a user to more easily determine visually the stiffness position of shoe 710. As shown in FIG. 23, a user may also be able to visually determine the position of tube 714, by merely determining the position of solid side 720. In addition, while only shown in the drawings as being of a circular cross section, it is noted that tube 714 may be many different cross sectional shapes. For example, tube 714 may be of any cross sectional shape, as long as enough clearance exists within channel 712 to allow tube 714 to be rotated. In another variation, tube 714 could be situated within a housing (not shown) that is capable of being rotated. This would allow similar varying of stiffness. Finally, it is contemplated to employ a tube 714 which, instead of being rotatable, is easily removed from channel 712. In such a design, the user would simply remove tube 714, flip such over and replace in channel 712. This would preferably accomplish the same goal as the above described rotatable tubes 714.

Manufacturing of tube 714 may be done in many different fashions. For example, a manufacturer may simply extrude a solid tube structure and thereafter slice the individual slits 716 in the tube. In addition, a manufacture could produce the individual segments 718 and thereafter affix them to a separately manufactured solid side or spine 720. Clearly, any means of affixing segments 718 to solid side 720 could be utilized in such a method. For example, gluing, cementing or welding could be performed. It is noted that manufacturing of shoe 710, in accordance with this seventh embodiment, may involve modifying shoe 710 itself to cooperate with tube 714. For example, in addition to the necessity of a channel 712, shoe 710 may also require differing elements than the above-described shoe 10. As shown in FIG. 19, a sole unit employed in shoe 710 may be of a different design. However, this is not necessary in all shoes manufactured in accordance with this seventh embodiment of the present invention. In addition, multiple tubes 714 may be employed, e.g. on medial or lateral sides of one shoe 10, permitting variations in stiffness between different portions of the shoe 10.

While the above embodiments are depicted in the drawings and discussed throughout as providing an adjustable shank 32 which is capable of varying the stiffness of sole unit 11 in a direction extending from the front of the foot (e.g.—toes) to the rear of the foot (e.g.—heal), it is to be understood that the stiffness of sole unit 11 may also be varied in a medial/lateral direction from the outside of the foot to the inside of the foot. Similarly, it is also contemplated to provide a tension adjustment mechanism which operates in this medial/lateral direction to control any adjustable shank 32 discussed herein. Further, it is also envisioned to provide a tension adjustment mechanism which is located at various positions on shoe 10. For example, although shown in the drawings as being located adjacent a heel section, a tension adjustment mechanism may be located in the forefoot or front section of shoe 10.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. An article of footwear comprising:

an upper defining a cavity for receiving a foot;

a sole unit attached to said upper; and an adjustable shank adapted to adjustably vary stiffness of said sole unit in a section corresponding to a forefoot of a wearer, the adjustable shank including a plurality of segments forming a continuous one-piece structure, wherein said adjustable shank is a rotatable member permanently contained within said article of footwear, and wherein rotation of the rotatable member varies the stiffness of said sole unit.

2. The article of footwear according to claim 1, wherein said sole unit includes an outsole and a midsole, and said adjustable shank is located between the outsole and the midsole.

3. The article of footwear according to claim 1, further comprising an adjustment mechanism coupled to said adjustable shank for adjusting said adjustable shank.

4. The article of footwear according to claim 3, wherein the adjustment mechanism cooperates with said sole unit.

5. The article of footwear according to claim 1, wherein the plurality of segments are connected at flex points.

6. The article of footwear according to claim 5, wherein the flex points are living hinges.

7. The article of footwear according to claim 1, wherein the plurality of individual segments cooperate with each other to adjustably vary the stiffness of said sole unit.

8. The article of footwear according to claim 1, wherein the rotatable member is a unitary body having a plurality of slits formed partially through the body.

9. The article of footwear according to claim 8, wherein the rotatable member is disposed in a channel formed in a portion of said article of footwear.

10. An adjustable shank member for use in an article of footwear, said adjustable shank member comprising:

a plurality of segments forming a continuous one-piece structure; and an adjustment assembly for adjusting the cooperation between said plurality of segments, wherein said adjustable shank member is adapted to vary stiffness of a sole unit of said article of footwear in a section corresponding to a forefoot of a wearer, at least a portion of said adjustable shank member is permanently dispose in a channel formed in a section of said article of footwear, and rotation of said adjustable shank member varies the stiffness of said sole unit.

11. The adjustable shank member according to claim 10, wherein the adjustable shank is a rotatable tube.

12. The adjustable shank member according to claim 11, wherein the tube has a circular cross section.

13. The adjustable shank member according to claim 11, wherein the rotatable tube is a unitary body having a plurality of slits formed partially through the body.

14. The adjustable shank member according to claim 13, wherein the rotatable tube includes at least one solid side.

15. The adjustable shank member according to claim 14, wherein the adjustment mechanism is connected with and capable of rotating a rotatable tube.

16. The adjustable shank member according to claim 15, wherein the adjustment mechanism is a dial structure.

17. The adjustable shank member according to claim 10, wherein said adjustment assembly includes an adjustment mechanism.

18. The adjustable shank member according to claim 10, wherein said plurality of segments are connected to each other at flex points.

19. The adjustable shank member according to claim 18, wherein the flex points are living hinges.

20. The article of footwear according to claim 9, wherein the rotatable member is a tube.

21. The article of footwear according to claim 20, wherein the tube has a circular cross section.

22. The article of footwear according to claim 8, wherein the rotatable member includes at least one solid side.

23. The article of footwear according to claim 1, wherein the rotatable member is connected with an adjustment mechanism capable of rotating the rotatable member.

24. The article of footwear according to claim 23, wherein the adjustment mechanism is a dial structure.

25. An article of footwear comprising:

an upper defining a cavity for receiving a foot;

a sole unit attached to said upper;

a rotatable member adapted to adjustably vary stiffness of said sole unit in a section corresponding to a forefoot of a wearer upon rotation, said rotatable member including a plurality of segments forming a continuous one-piece structure; and an adjustment mechanism capable of rotating said rotatable member, wherein said adjustable shank is permanently contained within said article of footwear.

26. The article of footwear according to claim 25, wherein said sole unit includes an outsole and a midsole, and said rotatable member is located between the outsole and the midsole.

27. The article of footwear according to claim 26, wherein said rotatable member is disposed in a channel formed in a portion of said article of footwear.

28. The article of footwear according to claim 25, wherein said plurality of segments are connected to each other at flex points.

29. The article of footwear according to claim 28, wherein the flex points are living hinges.

30. The article of footwear according to claim 25, wherein plurality of segments are separated by a plurality of slits.

31. The article of footwear according to claim 30, wherein said rotatable member includes at least one solid side.

32. The article of footwear according to claim 25, wherein said rotatable member is a tube.

33. The article of footwear according to claim 32, wherein the tube has a circular cross section.

34. The article of footwear according to claim 25, wherein the adjustment mechanism is a dial structure.

* * * * *

UNITED STATES PATENT AND TRADEMARK OFFICE

CERTIFICATE OF CORRECTION

PATENT NO. : 7,540,100 B2
APPLICATION NO. : 11/436920
DATED : June 2, 2009
INVENTOR(S) : Christopher J. Pawlus et al.

It is certified that error appears in the above-identified patent and that said Letters Patent is hereby corrected as shown below:

Column 2, line 12, "ad the" should read --and the--.
Column 2, line 22, "be couple to" should read --be coupled to--.
Column 2, line 58, "segment" should read --segments--.
Column 3, line 43, "grove joint" should read --groove joint--.
Column 3, line 47, "grove joint" should read --groove joint--.
Column 7, line 7, "34d are preferably" should read --34d is preferably--.
Column 8, line 32, "steel braided cable, but may be may other" should read --steel-braided cable, but may be other--.
Column 8, line 41, "not necessary," should read --not necessarily,--.
Column 11, line 14, "are preferably" should read --is preferably--.
Column 12, line 52, "484 may" should read --484, may--.
Column 12, line 56, "This clearly, allows" should read --This clearly allows--.
Column 12, line 57, "Stiffening element is" should read --Stiffening element 482 is--.
Column 13, line 41, "like shaped" should read --like-shaped--.
Column 14, line 32, "with 710" should read --with shoe 710--.
Column 16, line 39, "dispose" should read --disposed--.
Column 18, line 10, "claim 25, wherein" should read --claim 25, wherein said--.

Signed and Sealed this

Third Day of August, 2010

David J. Kappos

David J. Kappos
*Director of the United States Patent and Trademark Office*